United States Patent [19]

Takahashi et al.

[11] Patent Number: 4,946,770

[45] Date of Patent: Aug. 7, 1990

[54] SILVER HALIDE COLOR PHOTOGRAPHIC MATERIAL

[75] Inventors: Osamu Takahashi; Tsumoru Hirano; Seiki Sakanoue, all of Kanagawa, Japan

[73] Assignee: Fuji Photo Film Co., Ltd., Kanagawa, Japan

[21] Appl. No.: 84,771

[22] Filed: Aug. 13, 1987

[30] Foreign Application Priority Data

Aug. 13, 1986 [JP] Japan ..... 61-189771

[51] Int. Cl.[5] ..... G03C 1/04; G03C 7/34

[52] U.S. Cl. ..... 430/545; 430/546; 430/552; 430/553; 430/631

[58] Field of Search ..... 430/545, 546, 552, 553, 430/631

[56] References Cited

U.S. PATENT DOCUMENTS

| | | | |
|---|---|---|---|
| 3,619,195 | 11/1971 | Van Campen | 430/545 |
| 4,358,533 | 11/1982 | Tokitou et al. | 430/546 |
| 4,448,850 | 5/1984 | Upson et al. | 430/545 |
| 4,581,324 | 4/1986 | Wolff et al. | 430/553 |
| 4,686,177 | 8/1987 | Aoki et al. | 430/552 |

FOREIGN PATENT DOCUMENTS

| | | |
|---|---|---|
| 542135 | 6/1957 | Canada . |
| 0146337 | 6/1985 | European Pat. Off. . |

OTHER PUBLICATIONS

Patent Abstracts of Japan, vol. 10, No. 157 (P-464) (2213), Jun. 6, 1986, abstracting JP-A-61 9652, Jan. 17, 1986.

Research Disclosure, No. 195, Jul. 1980, pp. 301 to 310, No. 19551, Industrial Opportunities, Havant, Hampshire, Great Britain "Photographic Applications of Latices".

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide color photographic material comprising a support having thereon at least one silver halide emulsion layer containing a dispersion, said dispersion comprising oleophilic fine particles containing (a) at least one oil-soluble cyan coupler represented by formula (I) (described herein) capable of forming substantially non-diffusible cyan dye upon coupling with an oxidation product of an aromatic primary amine developing agent, and (b) a water-insoluble, organic solvent-soluble homopolymer or copolymer comprising not more than about 20% by weight of a repeating unit having an acid radical in the main chain or a side chain thereof, wherein the dispersion does not contain high-boiling point organic solvents. The photographic material provides color images excellent in preservability, particularly resistance to dark discoloration and light discoloration in good balance.

6 Claims, No Drawings

SILVER HALIDE COLOR PHOTOGRAPHIC MATERIAL

FIELD OF THE INVENTION

The present invention relates to a silver halide color photographic material, and, more particularly, to a silver halide color photographic material providing cyan dye images which are excellent in preservability.

BACKGROUND OF THE INVENTION

When color photographic light-sensitive materials are intended to be more or less permanently balance of yellow, magenta, and cyan dye images be equal to the initial three color balance by minimizing light discoloration and dark discoloration. However, since the Yellow, magenta, and cyan dye images show different degrees of light and dark discoloration, the balance of these three colors is often lost through long-term preservation, thus deteriorating image qualities.

Degrees of light and dark discoloration naturally differ depending on the couplers used in the light-sensitive materials and other factors. In many cases, however, dye images tend to undergo dark discoloration in the order of cyan dyes, yellow dyes, and magenta dyes. The degree of dark discoloration of a cyan dye image is particularly greater than those of other dye images. Likewise, dye images tend to undergo light discoloration in the order of cyan dye images, yellow dye images, and magenta dye images, particularly when exposed to light rich in ultraviolet rays.

With these considerations in mind, it has been keenly demanded to minimize such light and dark discoloration of cyan dye images in order to better balance the degrees of discoloration of yellow, magenta, and cyan colors. Many attempts have been made to this effect. These conventional attempts can be classified into two categories, one being directed to developing couplers that may form dye images free from discoloration; the other being to develop additives that may prevent discoloration.

In particular, an improvement as to preventing dark discoloration of cyan dye images is of great commercial importance, as is apparent from the need to preserve photographs (e.g., in albums, etc.) in home life for extremely long periods of time. Various proposals have been made thus far to attain such a result; however, effects to although some progress has been made, the effects of such efforts are not satisfactory.

A number of cyan dye forming phenol couplers are known. For example, 2-["-2,4-di-t-amylphenoxybutaneamido]-4,6-dichloro-5-methyl-phenol, disclosed in U.S. Pat. No. 2,801,171, produces cyan dye images which are satisfactory in light-fastness, but inferior in heat-fastness.

Further, 2,5-diacylaminophenol cyan couplers having acylamino groups at the 2- and 5-positions of the phenol nucleus are disclosed, e.g., in U.S. Pat. Nos. 2,369,929, 2,772,162 and 2,895,826, and Japanese Patent Application (OPI) Nos. 112038/75 (U.S. Pat. No. 4,009,035), 109630/78 (U.S. Pat. No. 4,124,396) and 163537/80 (U.S. Pat. No. 4,299,914) (the term "OPI" as used herein means a "published unexamined Japanese patent application"). Although these 2,5-diacylaminophenol couplers produce cyan dye images having satisfactory light-fastness, they also result in the disadvantages of poor color developability, light discoloration of resulting cyan dye images, and undesirable yellowing arising from the light-irradiation of unreacted cyan couplers. Further, these 2,4-diacylaminophenol couplers could be improved as to heat-fastness.

1-Hydroxy-2-naphthamide cyan couplers are generally unsatisfactory in terms of both light discoloration and dark discoloration of resulting images.

1-Hydroxy-2-acylaminocarbostyril cyan couplers, as disclosed in Japanese Patent Application (OPI) No. 104333/81, form cyan dye images which exhibit satisfactory fastness to light and heat, but whose spectral absorption characteristics do not favor color reproduction. Moreover, such couplers have problems, such as pink stain formation upon light irradiation.

The cyan polymeric couplers described in U.S. Pat. No. 3,767,412 and Japanese Patent Application (OPI) Nos. 65844/84 and 39044/86 are superior in heat-fastness under dry conditions, but inferior in heat-fastness under high humidity conditions, and are also insufficient in color developability.

Phenol couplers substituted with an alkyl group having 2 or more carbon atoms at the m-position thereof, as described in Japanese Patent Publication No. 11572/74, Japanese Patent Application (OPI) Nos. 117249/85, 205446/85, 209735/85 and 39045/86, are excellent in heat-fastness, but still insufficient.

On the other hand, when these couplers are incorporated into silver halide emulsion layers, they are commonly dispersed in high-boiling point organic solvents, as described in U.S. Pat. Nos. 2,322,027, 2,801,117, 2,870,012 and 2,991,177, etc. It is believed, however, that transfer of the high-boiling point organic solvents or couplers to other layers is one of the causes of deterioration in photographic properties and film properties of photographic materials, particularly multilayer light-sensitive materials, when preserved under conditions of high temperature and high humidity. Therefore, the use of high-boiling point organic solvents for dispersion is likely to result in such deterioration.

Polymers may be used for dispersing couplers in place of such high-boiling point organic solvents, as described in Japanese Patent Publication No. 30494/73 (U.S. Pat. No. 3,619,195) and Japanese Patent Application (OPI) No. 25133/76 (U.S. Pat. No. 4,201,589). Although the use of these techniques has brought about some improvement as to image preservability, the effects attained are still insufficient. For example, the present inventors have determined that the copolymers comprising hydrophilic monomers, e.g., acrylic acid, as disclosed in Japanese Patent Publication No. 30494/73, deteriorate image preservability under conditions of high temperature and high humidity It is further taught, e.g., in U.S. Pat. No. 4,203,716, that a hydrophobic substance, such as an oil-soluble coupler, is dissolved in a water-miscible organic solvent, and the solution is then mixed with a polymer latex to thereby impregnate the polymer with the hydrophobic substance. However, this technique encounters the problem that resultant cyan dye images are inferior in light-fastness, as compared with the case of using water-immiscible high-boiling point organic solvents. In addition, a large quantity of the polymer would be required to obtain sufficient impregnation of couplers thereinto to obtain sufficiently high maximum color density.

SUMMARY OF THE INVENTION

Accordingly, one object of the present invention is to provide a silver halide color photographic material which forms dye images excellent in cyan dye preservability, particularly in resistance to dark discoloration due to heat and humidity.

Another object of the present invention is to provide a silver halide color photographic material which forms dye images exhibiting excellent preservability, even under conditions of high temperature and high humidity, while minimizing and balancing the degrees light discoloration and dark discoloration of cyan, yellow and magenta colors, respectively.

A further object of the present invention is to provide a silver halide color photographic material which is free from deterioration in photographic properties and physical properties, such as transfer of high-boiling point organic solvents, even when preserved under conditions of high temperature and high humidity for long periods of time.

A still further object of the present invention is to provide a silver halide color photographic material which provides cyan dye images whose resistance to dark discoloration is improved without impairing resistance to light discoloration.

As a result of extensive investigations, it has now been found that the above and other objects can be accomplished by a silver halide color photographic material comprising a support having thereon at least one silver halide emulsion layer containing a dispersion, said dispersion comprising olephilic fine particles containing (a) at least one oil-soluble cyan coupler represented by formula (I) shown below, said coupler being capable of forming a substantially non-diffusible cyan dye upon coupling with an oxidation product of an aromatic primary amine developing agent, and (b) a water-insoluble, organic solvent-soluble homopolymer or copolymer comprising not more than about 20% by weight of a repeating unit having an acid radical in the main chain or a side chain thereof wherein said dispersion does not contain high-boiling point organic solvents.

DETAILED DESCRIPTION OF THE INVENTION

The term "acid radical" as used herein means a residue of an acid molecule (inclusive of a salt thereof) remaining after removal of a hydrogen atom, and capable of being replaced with a metal element, which constitutes an anionic moiety of a salt. The term "repeating unit having an acid radical" means a repeating unit having a carboxylic acid group or a sulfonic acid group; a repeating unit having a phenol or naphthol moiety having at least one electron-attractive group at the ortho- or para-position to a hydroxyl group thereof so that the hydroxyl group provides a pKa value of about 10 or less; a repeating unit having an active methylene moiety providing a pKa value of about 10 or less; and a salt of any of the above repeating units. Accordingly, a coupler structure is regarded herein as an acid radical.

The oil-soluble cyan couplers according to the present invention are represented by formula (I)

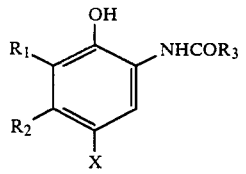

(I)

wherein $R_1$ represents a hydrogen atom or a halogen atom; $R_2$ represents a straight chain or branched chain, substituted or unsubstituted alkyl group having from 2 to 15 carbon atoms; $R_3$ represents a ballast group; and X represents a hydrogen atom or a coupling releasable group.

Of the cyan couplers represented by formula (I), preferred are those represented by formulae (II) or (III), described below:

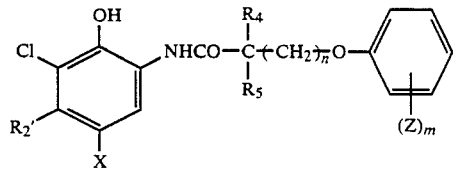

(II)

wherein X is as defined above for formula (I); $R_2'$ represents an alkyl group having from 2 to 4 carbon atoms; $R_4$ and $R_5$, which may be the same or different, each represents a hydrogen atom or an alkyl group; n represents 0 or an integer of from 1 to 3; Z represents an alkyl group having from 1 to 16 carbon atoms; m represents an integer of from 1 to 2; and the total number of carbon atoms in $(Z)_m$, $R_4$, and $R_5$ is at least 8;

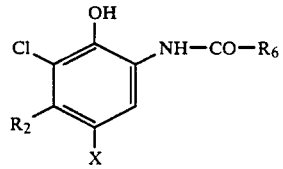

(III)

wherein $R_2$ and X are as defined above in formula (I); and $R_6$ represents an unsubstituted straight chain or branched chain aliphatic hydrocarbon group, or a straight chain or branched chain aliphatic hydrocarbon group substituted with at least one of a chlorine atom, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an alkyloxycarbonyl group, a carboxyl group, and a hydroxyl group, or $R_6$ represents a divalent group capable of linking to form a dimer or higher polymer.

In formula (I), the ballast group represented by $R_3$ is an organic group having of such size and shape so as to provide sufficient bulkiness to the coupler molecule as a whole, thus substantially preventing diffusion of the coupler from the layer of the photographic material into which the coupler is provided to other layers. Typical organic ballast groups include an alkyl group or aryl group having from 8 to 32 total carbon atoms. These alkyl and aryl groups may be substituted. Examples of suitable substituents for the aryl group include an alkyl group, an aryl group, an alkoxy group, an allyloxy group, a carboxyl group, an acyl group, an ester group, a hydroxy group, a cyano group, a nitro group, a carbamoyl group, a carbonamido group, an alkylthio group, an arylthio group, a sulfonyl group, a sulfonamido group, a sulfamoyl group, and a halogen atom. Examples of suitable substituents for the alkyl group are the same as those for the aryl group, with the exception of an alkyl group.

In formulae (I) and (III), acceptable substitutents for the alkyl group represented by $R_2$ include an aryl group, a heterocyclic group, an alkoxy group (e.g., a methoxy group, a 2-methoxyethoxy group, etc.), an aryloxy group (e.g., a 2,4-di-t-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group, (e.g., an acetylamino group, an ethylcarbamoyl group a dimethylcarbamoyl group, a methanesulfonamido group, a butylsulfamoyl group, etc.), a sulfamido group (e.g., a dipropylsulfamoylamido group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxyl group, a cyano group, a carboxyl group, a nitro group, a sulfo group, and a halogen atom.

In formulae (I) and (III), $R_2$ preferably represents a straight chain or branched chain alkyl group having from 2 to 4 carbon atoms, and more preferably represents an ethyl group.

The coupling releasable group as represented by X in formulae (I), (II) and (III) includes a halogen atom (e.g., a fluorine atom, a chloride atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methacesulfonylamino group, a toluenesulfonylamino group, etc.), an alkoxycarbcnyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic or heterocyclic thio group (e.g., an ethylthio group, a phenylthio group, a tetrazolylthio group, etc.), an imido group (e.g., a succinimido group, a hydantoinyl group, etc.), and the like. These releasable groups may further contain photographically useful groups such as a development inhibitor-releasing group, a development accelerator-releasing group and an aromatic azo group (e.g., a phenylazo group, etc.).

X preferably represents a hydrogen atom, a halogen atom, an aryloxy group, an alkyloxy group, or a sulfonamido group, with a fluorine atom and a chlorine atom being particularly preferred.

The couplers represented by formula (III) include bis-compounds composed of two coupler residues of formula (III) linked at a divalent group represented by $R_6$, as well as oligomers or polymers containing the coupler residue of formula (III) in their main chain or in a side chain. In particular, such polymeric couplers may be derived from an ethylenically unsaturated compound (hereinafter referred to as a vinyl monomer) containing the moiety represented by formula (III). In this case, $R_6$ represents a repeating unit and its linking moiety is contained in the polymerizable main chain.

In cases where $R_6$ represents a divalent group capable of linking to form a bis-compound, $R_6$ preferably represents a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

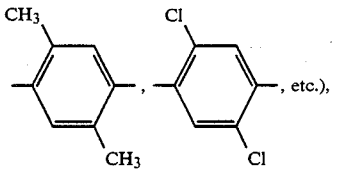

an —NHCO—A—CHONH— group, wherein A represents a substituted or unsubstituted alkylene or phenylene group (e.g., $—NHCOCH_2CH_2CONH—$,

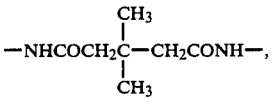

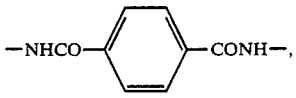

an —S—B—S— group, wherein B represents a substituted or unsubstituted alkylene group

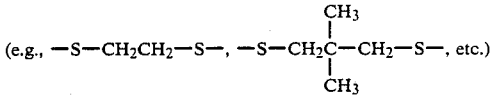

In polymeric couplers where the moiety represented by formula (III) is contained in the vinyl monomer, the linking group represented by $R_6$ includes a substituted or unsubstituted alkylene group (e.g., a methylene group, an ethylene group, a 1,10-decylene group, $—CH_2CH_2OCH_2CH_2—$, etc.), a substituted or unsubstituted phenylene group (e.g., a 1,4-phenylene group, a 1,3-phenylene group,

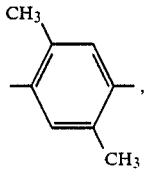

-continued

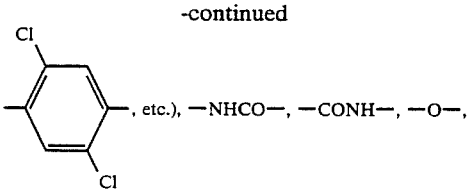

, etc.), —NHCO—, —CONH—, —O—,

—OCO—, an aralkylene group (e.g.,

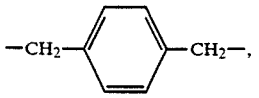

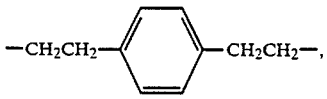

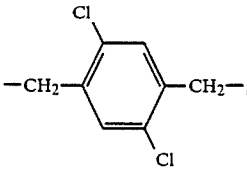

, etc.), and combinations thereof.

Preferred among these linking groups are —NHCO—,

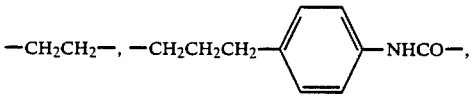

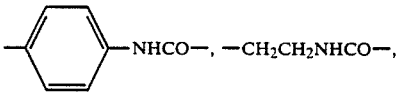

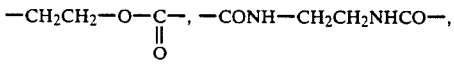

—CH₂CH₂O—CH₂CH₂—NHCO—, and

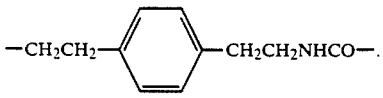

The vinyl monomer may have substituents other than those represented by formula (III), and preferred substituents include a hydrogen atom, a chlorine atom, and a lower alkyl group having from 1 to 4 carbon atoms (e.g., a methyl group, an ethyl group, etc.).

The polymeric couplers comprising the vinyl monomer containing the moiety represented by formula (III) include not only homopolymers of the vinyl monomer, but also copolymers thereof with non-color-forming ethylenically unsaturated monomers which do not undergo a coupling reaction with and oxidation product of an aromatic primary amine developing agent.

Such non-color-forming ethylenically unsaturated monomers include acrylic acid, α-chloroacrylic acid, α-alacrylic acids (e.g., methacrylic acid) or esters or amides of these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxymethacrylate, etc.), methylenedibisacrylamide, vinyl esters (e.g., vinyl acetate, vinyl propionate, vinyl laurate, etc.), acrylonitrile, methacrylonitrile, aromatic vinyl compounds (e.g., styrene and its derivatives, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), maleic acid, maleic anhydride, maleic esters, N-vinyl-2-pyrrolidone, N-vinylpyridine, and 2- or 4-vinylpyridine. These non-color-forming ethylenically unsaturated monomers may be used in combinations of two or more thereof, if desired. Such combinations include a combination of n-butyl acrylate and methyl acrylate, a combination of styrene and methacrylic acid, a combination of methacrylic acid and acrylamide, a combination of methyl acrylate and diacetonacrylamide, etc.

As is well known in the art of polymeric couplers, the non-color-forming ethylenically unsaturated monomers to be copolymerized with the solid water-insoluble vinyl monomer coupler are selected so that the resulting copolymers impart desirable influences on the physical properties and/or chemical properties of the silver halide photographic materials of the present invention, such as solubility, compatibility with binders of photographic colloidal compositions (e.g., gelatin), flexibility, thermal stability, and the like.

The polymeric couplers which can be used in the present invention may be either water-soluble or water-insoluble. Preferred among them are polymeric coupler latices.

The cyan couplers according to the present invention can be synthesized by the known methods described in Japanese Patent Application (OPI) Nos. 117249/85, 209735/85 and 39045/86 and U.S. Pat. No. 3,772,002, etc. These synthesis methods are incorporated herein by reference.

Specific examples of the cyan couplers of formula (I) according to the present invention are shown below. In the cases of polymeric couplers, the copolymerization ratios are given by weight.

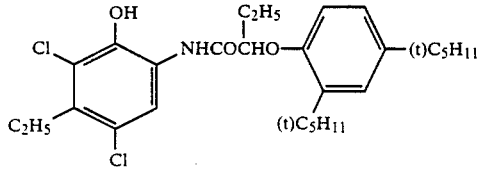

(C-1)

-continued
(C-2)
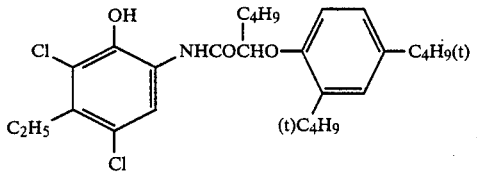
(C-3)
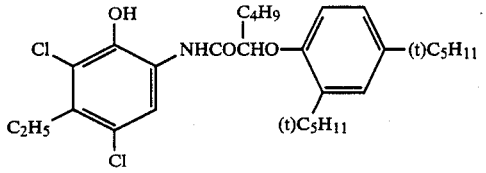
(C-4)
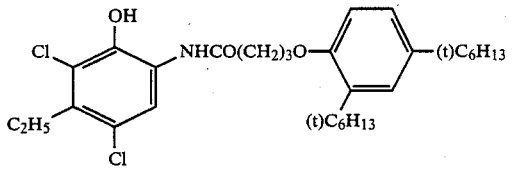
(C-5)
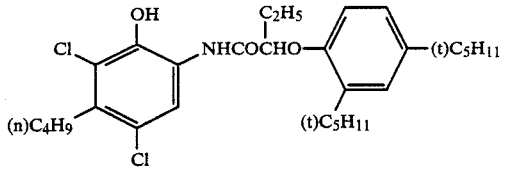
(C-6)
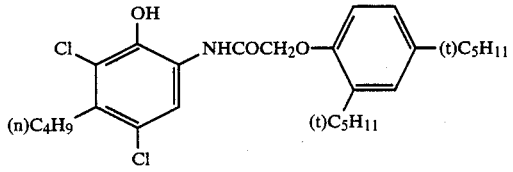
(C-7)
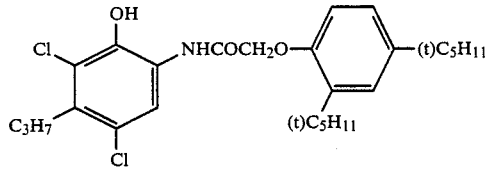
(C-8)
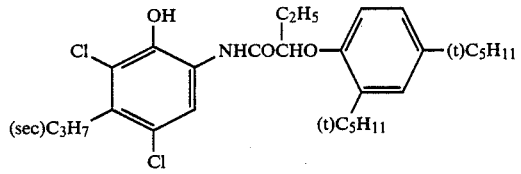
(C-9)
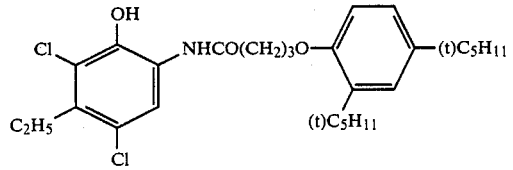

-continued
(C-10)
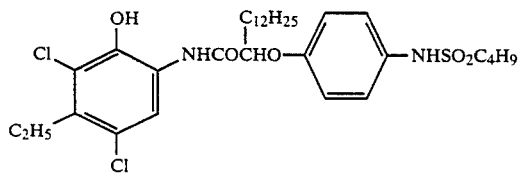
(C-11)
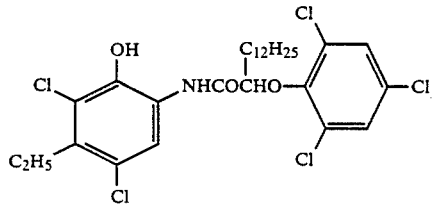
(C-12)
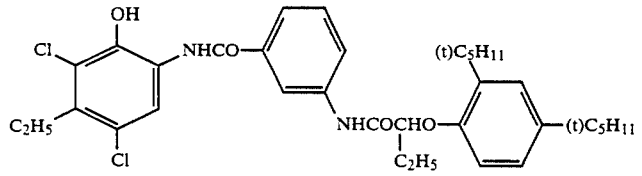
(C-13)
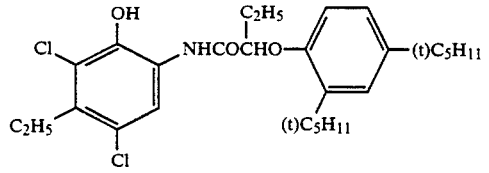
(C-14)
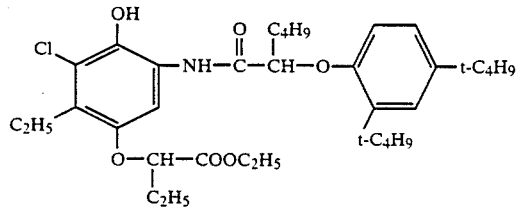
(C-15)
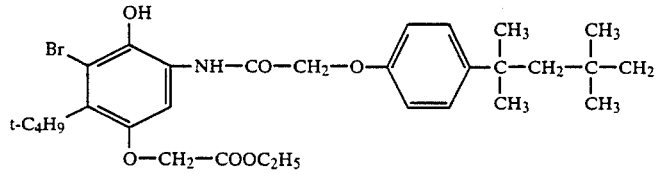
(C-16)
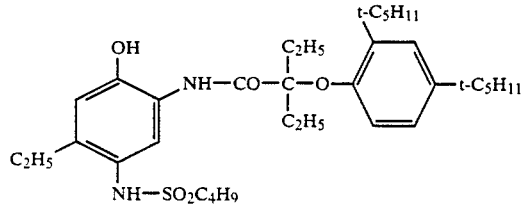

-continued
(C-17)
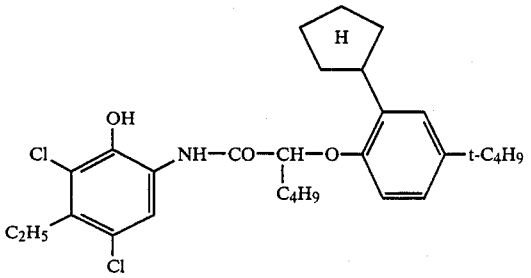
(C-18)
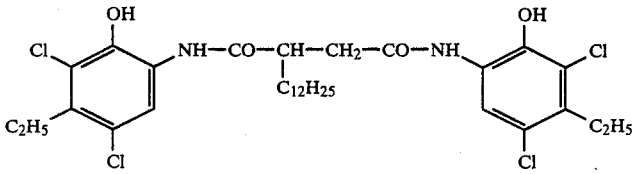
(C-19)
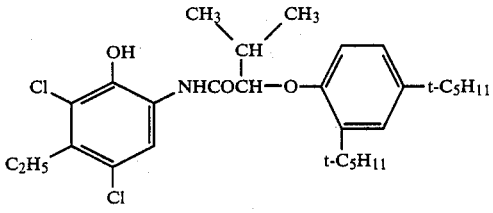
(C-20)
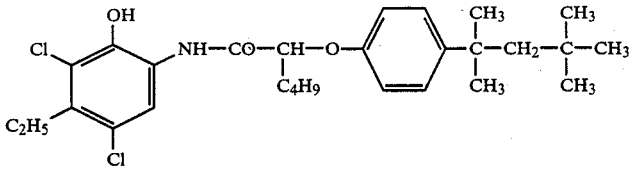
(C-21)
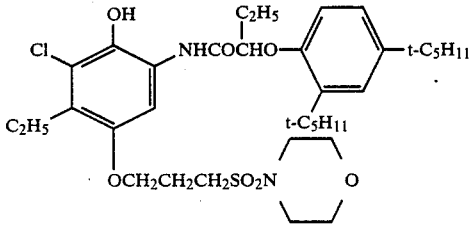
(C-22)
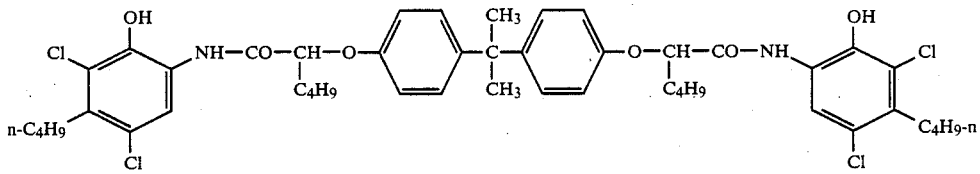
(C-23)
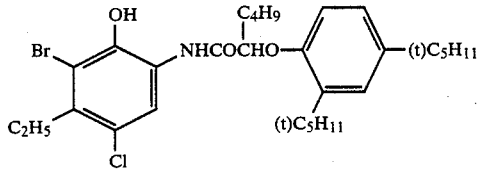
(C-24)
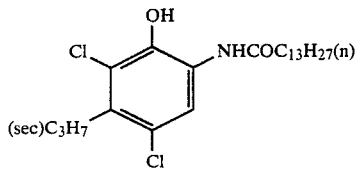

-continued
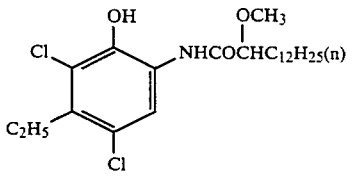
(C-25)
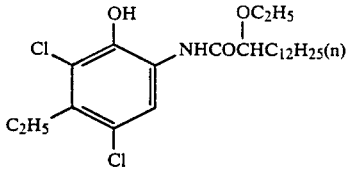
(C-26)
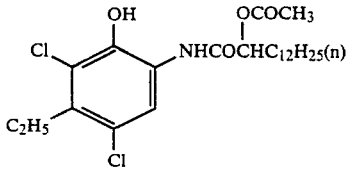
(C-27)
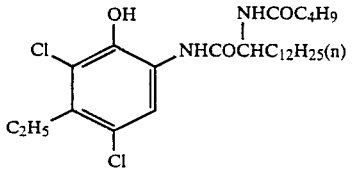
(C-28)
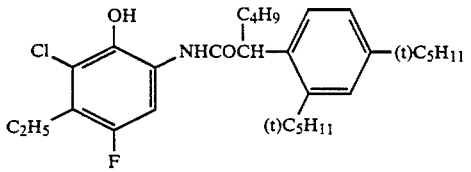
(C-29)
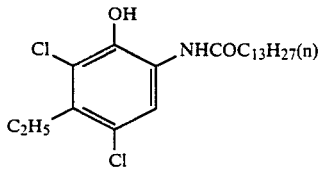
(C-30)
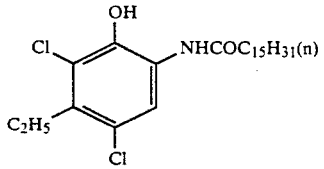
(C-31)
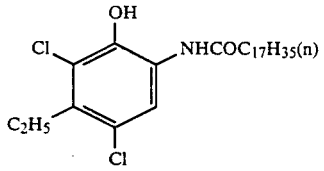
(C-32)
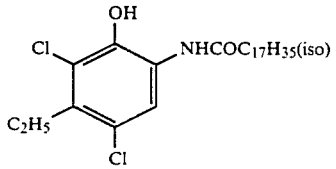
(C-33)

-continued
(C-34)
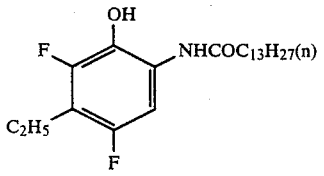
(C-35)
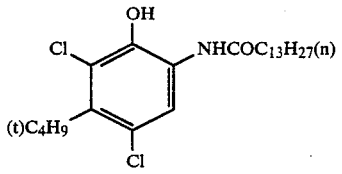
(C-36)
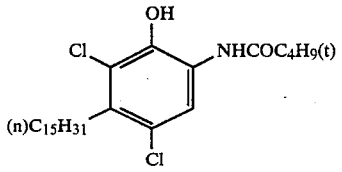
(C-37)
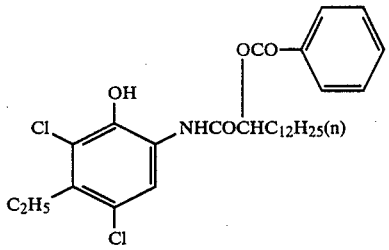
(C-38)
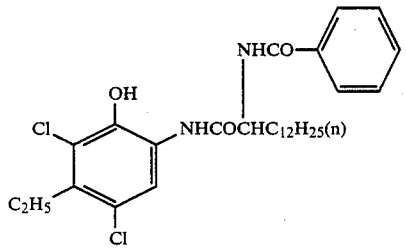
(C-39)
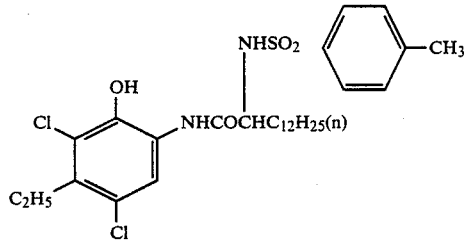
(C-40)
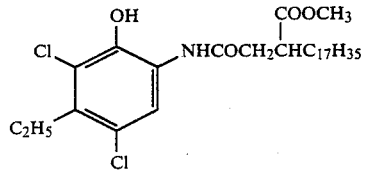

-continued
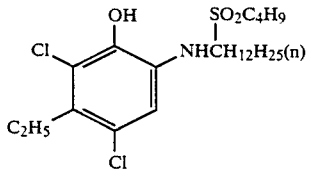
(C-41)
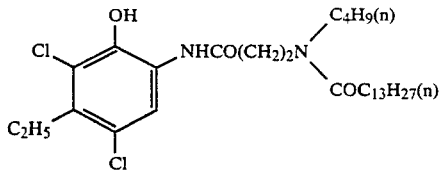
(C-42)
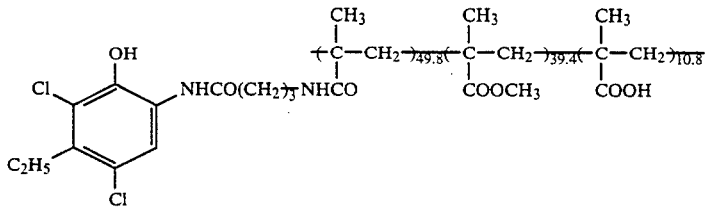
(C-43)
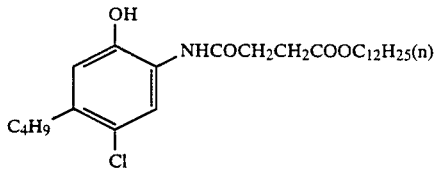
(C-44)
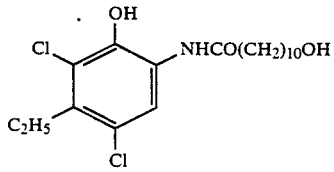
(C-45)
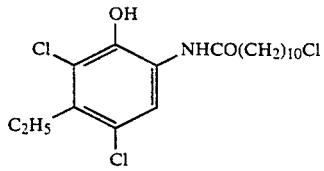
(C-46)
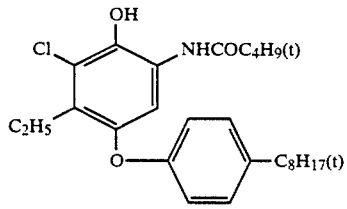
(C-47)
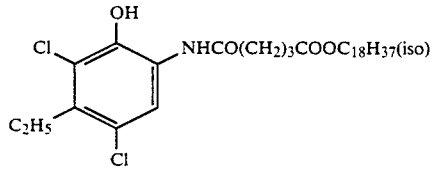
(C-48)

-continued

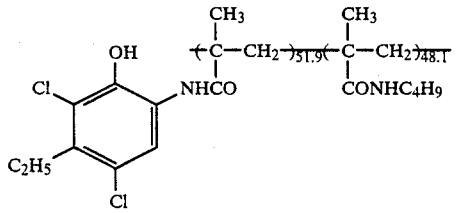

(C-49)

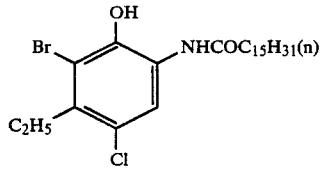

(C-50)

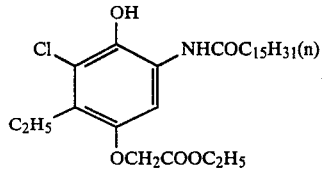

(C-51)

The polymers which can be used in the dispersion system according to the present invention may be any of water-insoluble and organic solvent-soluble polymers, as long as they contain not more than about 20% by weight of a repeating unit having an acid radical in the main or side chain thereof. Polymers comprising a repeating unit having

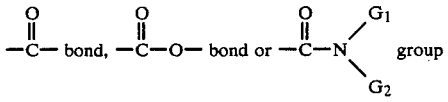

(wherein $G_1$ and $G_2$ each represents a hydrogen atom, a substituted or unsubstituted alkyl group, or a substituted or unsubstituted aryl group), in which

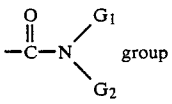

is preferably in a side chain, are preferred in view of their resultant effects in preventing discoloration. If polymers comprising more than about 20% by weight of a repeating unit containing an acid radical are employed, such effects in preventing discoloration are seriously reduced for some unexplainable reason. Hence, the weight proportion of the acid radical-containing repeating unit in the polymer should be not more than about 20 wt %, preferably not more than 5 wt %, more preferably not more than 2 wt %, and most preferably 0 wt %. These polymers according to the present invention will be desirable below by way of specific but non-limiting examples.

(A) Vinyl Polymers and Copolymers

Monomers forming the vinyl polymers include acrylic esters, e.g., methyl acrylate, ethyl acrylate, n-propyl acrylate, isopropyl acrylate, n-butyl acrylate, isoutyl acrylate, sec-butyl acrylate, t-butyl acrylate, amyl acrylate, hexyl acrylate, 2-ethylhexyl acrylate, octyl acrylate, t-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, nethoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl- acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition mol number: n=9), 1-bromo-2-methoxyethyl acrylate, 1,1-dichloro-2-ethoxyethyl acrylate, etc.; methacrylic esters, e.g., methyl xethacrylate, ethyl xethacrylate, n-propyl methacrylate, isopropyl methacrylate, n-butyl methacrylate, isobutyl methacrylate, sec-butyl methacrylate, t-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition mol number: n=6), allyl methacrylate, dimethylaminoethylmethyl methacrylate chloride, etc.; vinyl esters, e.g., vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.; acrylamides, e.g., acrylamide, methylacrylamide, ethylacrylamide, propylacrylamide, butylacrylamide, t-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetacetoxyethyl)acrylamide, diacetonacrylamide, etc.; methacrylamides, e.g., methacrylamide, methylmethacrylamide, ethylmethacrylamide, propylmethacrylamide, butylmethacrylamide, t-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetacetoxyethyl)methacrylamide, etc.; olefins, e.g., dicyclopentadiene, ethylene, propylene, 1-butene, 1-pentene, vinyl chloride, vinylidene chloride, isoprene, chloroprene, butadiene, 2,3-dimethylbutadiene, etc.; styrenes, e.g., styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, methyl vinylbenzoate, etc.; vinyl ethers, e.g., methyl vinyl ether, butyl vinyl ether, hexyl vinyl ether, methoxyethyl vinyl ether, dimethylaminoethyl vinyl ether, etc.; butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylenemalonitrile, vinylidene, and so on.

These vinyl monomers can be used in combinations of two or more thereof, depending on the purposes therefor, such as improvement of solubility. Further, in order to control color developability of solubility, monomers having an acid radical may be used as comonomers up to a proportion of about 20% by weight. Examples of such acid radical-containing comonomers include acrylic acid, methacrylic acid, itaconic acid, maleic acid, monoalkyl itaconate (e.g., monomethyl itaconate, monoethyl itaconate, monobutyl itaconate), monoalkyl maleates (monomethyl maleate, monoethyl maleate, monobutyl maleate, etc.), citraconic acid, styrenesulfonic acid, vinylbenzylsulfonic acid, vinylsulfonic acid, acryloyloxyalkylsulfonic acids (e.g., acryloyloxymethylsulfonic acid, acryloyloxyethylsulfonic acid, acryloyloxypropylsulfonic acid, etc.), methacryloyloxyalkylsulfonic acids (e.g., methacryloyloxymethylsulfonic acid, methacryloyloxyethylsulfonic acid, methacryloyloxypropylsulfonic acid, etc.), acrylamidoalkylsulfonic acids (e.g., 2-acrylamido-2-methylethanesulfonic acid, 2-acrylamido-2-methylpropanesulfonic acid, 2-acrylamido-2-methylbutanesulfonic acid, etc.), methacrylamidoalkylsulfonic acids (e.g., 2-methacrylamido-2-methylethanesulfonic acid, 2-methacrylamido-2-methylpropanesulfonic acid, 2-methacrylamido-2-methylbutanesulfonic acid, etc.), and so on.

These acids may be in the form of a salt with an alkali metal (e.g., Na, K, etc.) or ammonium ion.

When a hydrophilic monomer among the foregoing vinyl monomers and other suitable vinyl monomers (i.e., a monomer forming a hydrophilic polymer upon homopolymerization) is used as a comonomer, the proportion of such a hydrophilic comonomer in the copolymer is not particularly limited, as long as the resulting copolymer is water-insoluble. In general, the proportion of the hydrophilic comonomer is not more than about 40 mol %, preferably not more than 20 mol %, and more preferably not more than 10 mol %.

Preferred vinyl monomers are acrylates, methacrylates, acrylamides, and methacrylamides. It is usually preferable to polymerize two or more monomers. It is more preferable to copolymerize an acrylamide monomer with other monomers of the present invention, or a methacrylate monomer with other monomers of the present invention.

Two or more different kinds of polymers may also be used in combination in accordance with the present invention.

(B) Polyester resins obtained by condensation between polyhydric alcohols and polybasic acids The polyhydric alcohols which are effective include glycols having a structure of HO—$R^1$—OH, wherein $R^1$ represents a hydrocarbon chain having from 2 to about 12 carbon atoms (preferably an aliphatic hydrocarbon chain), and polyalkylene glycols. The polybasic acids which are effective include those having a structure of HOOC—$R^2$—COOH, wherein $R^2$ represents a mere bond or a hydrocarbon chain having from 1 to 12 carbon atoms.

Specific examples of the polyhydric alcohols are ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexaendiol, 1,7-heptanediol, 1,8-octanediol, 1,9-nonanediol, 1,10-decanediol, 1,11-undecanediol, 1,12-dodecanediol, 1,13-tridecanediol, 1,4-diol, glycerin, diglycerin, triglycerin, 1-methylglycerin, erythritol, mannitol, sorbitol and the like.

Specific examples of the polybasic acids are oxalic acid, succinic acid, glutaric acid, adipic acid, pimelic acid, cork acid, azelaic aid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, a mesaconic acid, isopimelic acid, a cyclopentadiene-maleic anhydride adduct, and a rosin-maleic anhydride adduct.

(C) Other polymers

Other polymers which can be used in the dispersion include, for example, polyesters having a repeating unit of $\left[C-O-(CH_2)_l\right]$ obtained by ring-opening polymerization of

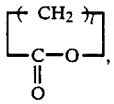

wherein represents an integer of from 4 to 7; and $(CH_2)_l$ may be straight or branched.

Suitable monomers for obtaining these polyesters include β-propiolactone, ε-caprolactone, dimethylpropiolactone, etc.

The polymers in the dispersion according to the present invention usually have a number average molecular weight of about 10,000 or more. The molecular weight per se is significantly influential which respect to obtaining the desired effects of the present invention, but polymers having too high molecular weights require much time for being dissolved in auxiliary solvents (low-boiling point organic solvents) or may be difficult to emulsify due to high solution viscosities, which may result-in formation of coarse particles. As a result, color developability may be reduced or coating properties may be deteriorated. On the other hand, to use a large quantity of an auxiliary solvent to decrease the solution viscosity causes additional problems in production processes. In view of these considerations, it is preferable that a solution of 30 g of the polymer in 100 ml of an auxiliary solvent has a viscosity of about 5000 cps or less, and more preferably 2000 cps or less. In this connection, the polymer to be used preferably has a number average molecular weight of 150,000 or less, more preferably 80,000 or less, and even more preferably 30,000 or less.

The proportion of the polymer to an auxiliary solvent may vary widely depending on the kind of polymer, the solubility thereof in the auxiliary solvent used, the degree of polymerization, etc. of the polymer used or the solubility of the coupler. In general, the auxiliary solvent is used in an amount necessary to decrease the viscosity of a solution containing both the coupler and the polymer so as to be easily dispersed in water or a hydrophilic colloid aqueous solution. Since the viscosity of the polymer/coupler solution increases as the degree of polymerization of the polymer increases, it is difficult to precisely determine the proportion of the polymer to the auxiliary solvent applicable to all the above-described types of polymers but, usually, such a proportion preferably ranges from about 1:1 to about 1:50 by weight. The weight ratio of the polymer to the coupler preferably ranges from about 1:20 to about 20:1, and more preferably from 1:10 to 10:1.

Specific but non-limiting examples of the polymer which can be used in the present invention are shown below. For copolymers, the copolymerization ratios are provided in parentheses by weight:

(P-1) Polyvinyl acetate
(P-2) Polyvinyl propionate
(P-3) Polymethyl methacrylate
(P-4) Polyethyl methacrylate
(P-5) Polyethyl acrylate
(P-6) Vinyl acetate-vinyl alcohol copolymer (95:5)
(P-7) Poly-n-butyl acrylate
(P-8) Poly-n-butyl methacrylate
(P-9) Polyisobutyl methacrylate
(P-10) Polyisopropyl methacrylate
(P-11) Polyoctyl acrylate
(P-12) n-Butyl acrylate-acrylamide copolymer (95:5)
(P-13) Stearyl methacrylate-acrylic acid copolymer (90:10)
(P-14) Poly-1,4-butanediol adipate
(P-15) Polyethylene glycol sebacate
(P-16) Polycaprolactam
(P-17) Polypropiolactam
(P-18) Polydimethylpropiolactone
(P-19) n-Butyl methacrylate-N-vinyl-2-pyrrolidone copolymer (90:10)
(P-20) Methyl methacrylate-vinyl chloride copolymer (70:30)
(P-21) Methyl methacrylate-styrene copolymer (90:10)
(P-22) Methyl methacrylate-ethyl acrylate copolymer (50:50)
(P-23) n-Butyl methacrylate-methyl methacrylate-styrene copolymer (50:30:20)
(P-24) Vinyl acetate-acrylamide copolymer (85:15)
(P-25) Vinyl chloride-vinyl acetate copolymer (65:35)
(P-26) Methyl methacrylate-acrylonitrile copolymer (65:35)
(P-27) Diacetonacrylamide-methyl methacrylate copolymer (50:50)
(P-28) Methyl vinyl ketone-isobutyl methacrylate copolymer (55:45)
(P-29) Ethyl methacrylate-n-butyl acrylate copolymer (70:30)
(P-30) Diacetonacrylamide-n-butyl acrylate copolymer (60:40)
(P-31) Methylmethacrylate-styrenemethyl methacrylate-diacetonacrylamide copolymer (40:40:20)
(P-32) n-Butyl acrylate-styrene methacrylate-diacetonacrylamide copolymer (70:20:10)
(P-33) Stearyl methacrylate-methyl methacrylate-acrylic acid copolymer (50:40:10)
(P-34) Methyl methacrylate-styrene-vinylsulfonamide copolymer (70:20:10)
(P-35) Methyl methacrylate-phenyl vinyl ketone copolymer (70:30)
(P-36) n-Butyl acrylate-methyl methacrylate-n-butyl methacrylate copolymer (35:35:30)
(P-37) n-Butyl methacrylate-penthyl methacrylate-N-vinyl-2-pyrrolidone copolymer (38:38:24)
(P-38) Methyl methacrylate-n-butyl methacrylate-isobutyl methacrylate-acrylic acid copolymer (37:29:25:9)
(P-39) n-Butyl methacrylate-acrylic acid copolymer (95:5)
(P-40) Methyl methacrylate-acrylic acid copolymer (95:5)
(P-41) Benzyl methacrylate-acrylic acid copolymer (90:10)
(P-42) n-Butyl methacrylate-methyl methacrylate-benzyl methacrylate-acrylic acid copolymer (35:35:25:5)
(P-43) n-Butyl methacrylate-methyl methacrylate-benzyl methacrylate copolymer (35:35:30)
(P-44) Polypentyl acrylate
(P-45) Cyclohexyl methacrylate-methyl methacrylate-n-propyl methacrylate copolymer (37:29:34)
(P-46) Polypentyl methacrylate
(P-47) Methyl methacrylate-n-butyl methacrylate copolymer (65:35)
(P-48) Vinyl acetate-vinyl propionate copolymer (75:25)
(P-49) n-Butyl methacrylate-sodium 3-acryloxybutane-1-sulfonate copolymer (97:3)
(P-50) n-Butyl methacrylate-methyl methacrylate-acrylamide copolymer (35:35:30)
(P-51) n-Butyl methacrylate-methyl methacrylate-vinyl chloride copolymer (37:36:27)
(P-52) n-Butyl methacrylate-styrene copolymer (90:10)
(P-53) Methyl methacrylate-N-vinyl-2-pyrrolidone copolymer (90:10)
(P-54) n-Butyl methacrylate-vinyl chloride copolymer (90:10)
(P-55) n-Butyl methacrylate-styrene copolymer (70:30)
(P-56) Poly(N-sec-butylacrylamide)
(P-57) Poly(N-t-butylacrylamide)
(P-58) Diacetonacrylamide-methyl methacrylate copolymer (62:38)
(P-59) Polycyclohexyl methacrylate
(P-60) N-t-Butylacrylamide-methyl methacrylate copolymer (40:60)
(P-61) Poly(N,N-dimethylacrylamide)
(P-62) Poly(t-butyl methacrylate)
(P-63) t-Butyl methacrylate-methyl methacrylate copolymer (70:30)
(P-64) Poly(n-t-butylmethacrylamide)

(P-65) N-t-Butylacrylamide-methylphenyl methacrylate copolymer (60:40)
(P-66) Methyl methacrylate-acrylonitrile copolymer (70:30)
(P-67) Methyl methacrylate-methyl vinyl ketone copolymer (38:62)
(P-68) Methyl methacrylate-styrene copolymer (75:25)
(P-69) Methyl methacrylate-hexyl methacrylate copolymer (70:30)
(P-70) Butyl methacrylate-acrylic acid copolymer (85:15)
(P-71) Methyl methacrylate-acrylic acid copolymer (80:20)
(P-72) Methyl methacrylate-acrylic acid copolymer (90:20)
(P-73) Methyl methacrylate-acrylic acid copolymer (98:2)
(P-74) Poly(benzylacrylate)
(P-75) Poly(4-biphenylacrylate)
(P-76) Poly(4-butoxycarbonylphenylacrylate)
(P-77) Poly(sec-butylacrylate)
(P-78) Poly(tert-butylacrylate)
(P-79) Poly[3-chloro-2,2-bis(chloromethyl)propylacrylate]
(P-80) Poly(2-chlorophenylacrylate)
(P-81) Poly(4-chlorophenylacrylate)
(P-82) Poly(pentachlorophenylacrylate)
(P-83) Poly(4-cyanobenzylacrylate)
(P-84) Poly(cyanoethylacrylate)
(P-85) Poly(4-cyanophenylacrylate)
(P-86) Poly(4-cyano-3-thiabutylacrylate)
(P-87) Poly(cyclohexylacrylate)
(P-88) Poly(2-ethoxycarbonylphenylacrylate)
(P-89) Poly(3-ethoxycarbonylphenylacrylate)
(P-90) Poly(4-ethoxycarbonylphenylacrylate)
(P-91) Poly(2-ethoxyethylacrylate)
(P-92) Poly(3-ethoxypropylacrylate)
(P-93) Poly(1H,1H,5H-octafluoropentylacrylate)
(P-94) Poly(heptylacrylate)
(P-95) Poly(hexadecylacrylate)
(P-96) Poly(hexylacrylate)
(P-97) Poly(iso-butylacrylate)
(P-98) Poly(iso-propylacrylate)
(P-99) Poly(3-methoxybutylacrylate)
(P-100) Poly(2-methoxycarbonylphenylacrylate)
(P-101) Poly(3-methoxycarbonylphenylacrylate)
(P-102) Poly(4-methoxycarbonylphenylacrylate)
(P-103) Poly(2-methoxyethylacrylate)
(P-104) Poly(4-methoxyphenylacrylate)
(P-105) Poly(3-methoxypropylacrylate)
(P-106) Poly(3,5-dimethyladamantylacrylate)
(P-107) Poly(3-dimethylaminophenylacrylate)
(P-108) Poly(vinyl-tert-butylate)
(P-109) Poly(2-methylbutylacrylate)
(P-110) Poly(3-methylbutylacrylate)
(P-111) Poly(1,3-dimethylbutylacrylate)
(P-112) Poly(2-methylpentylacrylate)
(P-113) Poly(2-naphtylacrylate)
(P-114) Poly(phenylacrylate)
(P-115) Poly(propylacrylate)
(P-116) Poly(m-tolylacrylate)
(P-117) Poly(o-tolylacrylate)
(P-118) Poly(p-tolylacrylate)
(P-119) Poly(N,N-dibutylacrylamide)
(P-120) Poly(iso-hexylacrylamide)
(P-121) Poly(iso-octylacrylamide)
(P-122) Poly(N-methyl-N-phenylacrylamide)
(P-123) Poly(adamantylmethacrylate)
(P-124) Poly(benzylmethacrylate)
(P-125) Polu(2-bromoethylmethacrylate)
(P-126) Poly(2-N-tert-butylaminoethylmethacrylate)
(P-127) Poly(sec-butylmethacrylate)
(P-128) Poly(tert-butylmethacrylate)
(P-129) Poly(2-chloroethylmethacrylate)
(P-130) Poly(2-cyanoethylmethacrylate)
(P-131) Poly(2-cyanomethylphenylmethacrylate)
(P-132) Poly(4-cyanophenylmethacrylate)
(P-133) Poly(cycloxylmethacrylate)
(P-134) Poly(dodecilmethacrylate)
(P-135) Poly(diethylaminoethylmethacrylate)
(P-136) Poly(2-ethylsulfinylethylmethacrylate)
(P-137) Poly(hexadecylmethacrylate)
(P-138) Poly(hexylmethacrylate)
(P-139) Poly(2-hydroxypropylmethacrylate)
(P-140) Poly(4-methoxycarbonylphenylmethacrylate)
(P-141) Poly(3,5-dimethyladamantylmethacrylate)
(P-142) Poly(dimethylaminoethylmethcrylate)
(P-143) Poly(3,3-dimethylbutylmethacrylate)
(P-144) Poly(3,3-dimethyl-2-butylmethacrylate)
(P-145) Poly(3,5,5-trimethylhexylmethacrylate)
(P-146) Poly(octadecylmethacrylate)
(P-147) Poly(tetradecylmethacrylate)
(P-148) Poly(4-butoxycarbonylphenylmethacrylamide)
(P-149) Poly(4-carboxyphenylmethacrylamide)
(P-150) Poly(4-ethoxycarbonylphenylmethacrylamide)
(P-151) Poly(4-methoxycarbonylphenylmethacrylamide)
(P-152) Poly(butylbutoxycarbonylmethacrylate)
(P-153) Poly(butylchloroacrylate)
(P-154) Poly(butylcyanoacrylate)
(P-155) Poly(cyclohexylchloroacrylate)
(P-156) Poly(ethylchloroacrylate)
(P-157) Poly(ethylethoxycarbonylmethacrylate)
(P-158) Poly(ethylethacrylate)
(P-159) Poly(ethylethacrylate)
(P-160) Poly(hexylhexyloxyca.bronylmethacrylate)
(P-161) Poly(iso-butylchloroacrylate)
(P-162) Polu(iso-propylchloroacrylate)

In the cyan coupler dispersion according to the present invention, the coupler represented by formula (I) is contained in oleophilic fine particles in the presence of the above-described water-insoluble and organic solvent-soluble homopolymer or copolymer, and in the absence of a high-boiling point organic solvent. Suitable cyan coupler dispersions include those obtained by dissolving at least one of the couplers of formula (I) and the homopolymer or copolymer in a low-boiling point organic solvent, and dispersing and emulsifying the resulting mixed solution in a hydrophilic binder and, in addition, dispersions obtained by suspension polymerization, solution polymerization or bulk polymerization of a monomer component(s) of the homopolymer or copolymer in the presence of the coupler and dispersing the polymerization mixture in a hydrophilic binder, as disclosed in Japanese Patent Application (OPI) No. 107642/85.

The dispersion containing oleophilic fine particles obtained by emulsification and dispersion can be prepared as follows. The polymer according to the present invention that is non-crosslinked (as produced by solution polymerization, emulsion polymerization, suspension polymerization, etc.), a so-called linear polymer, and the coupler of the present invention are completely dissolved in an auxiliary organic solvent, and the resulting solution is finely dispersed in water (preferably a hydrophilic colloid aqueous solution, and more preferably a gelatin aqueous solution), with the aid of a dispersing agent by means of ultrasonic waves, a colloid mill, etc. The resulting dispersion is then incorporated into a silver halide emulsion Alternatively, water or a hydrophilic colloid aqueous solution (e.g., a gelatin aqueous solution) is added to an auxiliary organic solvent containing a dispersing aid (e.g., a surface active agent), the polymer of the present invention, and the coupler of the present invention to induce a phase transfer to obtain an oil-in-water dispersion. If desired, the auxiliary organic solvent can be removed from the resulting dispersion by distillation, noodle washing, ultra-filtration or a similar technique prior to mixing with a photographic emulsion.

Suitable auxiliary organic solvents which can be used include organic solvents useful for dispersion and substantially completely removable from light-sensitive materials by the above-mentioned techniques. Such auxiliary organic solvents include low-boiling point organic solvents and solvents which are water soluble to some extent, and are removable by washing and the like. Examples of the auxiliary organic solvent are lower alcohol acetates (e.g., ethyl acetate, butyl acetate, propyl acetate, etc.), ethyl propionate, butyl propionate, sec-butyl alcohol, methyl ethyl ketone, methyl isobutyl ketone, $\beta$-ethoxyethyl acetate, methyl cellosolve acetate, cyclohexanone dimethylformamide, dioxane and diethylene glycol.

If desired, a portion of the auxiliary organic solvents to be employed may be replaced with an organic solvent which is completely miscible with water, such as methyl alcohol, ethyl alcohol, acetone, tetrahydrofuran, etc.

These organic solvents may be used either individually or in combinations of two or more thereof.

The thus obtained oleophilic fine particles preferably have an average particle size of from about 0.04 to about 2 $\mu$m, and more preferably from 0.06 to 0.4 $\mu$m. The particle size of the oleophilic particles can be determined by the use of, for example, "Nanosizer" manufactured by Coal Tar Co., Ltd., G.B.

The aforesaid high boiling point organic solvents are good solvents for couplers which are water-immiscible and have a melting point of about 100° C. or lower and a boiling point of about 140° C. or higher. Specific examples of such high-boiling point organic solvents include esters, such as phthalates (e.g., dibutyl phthalate) and phosphates (e.g., tricresyl phosphate), organic acid amides, carbamates, ketones, and the like. Further descriptions of such high-boiling point organic solvents can be found, e.g., in U.S. Pat. Nos. 2,322,027, 2,801,170, 2,801,171, 2,870,012 and 2,991,177.

The cyan coupler represented by formula (I) according to the present invention can be incorporated in a silver halide emulsion layer in an amount of from about 0.01 to about 2 mols, and preferably from 0.1 to 1.0 mol, per mol of silver halide.

The homopolymer or copolymer of the present invention can be present in the dispersion on a weight ratio basis of from about 0.1 to about 10, and preferably from 0.3 to 2, based on the coupler.

Magenta couplers to be used in combination with the cyan couplers include oil-protected type indazolone couplers, cyanoacetyl couplers, and preferably pyrazolone couplers and pyrazoloazole couplers, such as pyrazolotriazoles.

Suitable pyrazolone couplers are 5-pyrazolone couplers, which preferably include those having an arylamino or acylamino group at the 3-position from the standpoint of obtaining excellent hue and density of developed colors. Typical examples of the 5-pyrazolone couplers are described in U.S. Pat. Nos. 2,311,082, 2,343,703, 2,600,788, 2,908,573, 3,062,653, 3,152,896 and 3,936,015. Preferred releasable groups for 2-equivalent 5-pyrazolone couplers are nitrogen atom-releasing groups as disclosed in U.S. Pat. No. 4,310,619, and an arylthio group as disclosed in U.S. Pat. No. 4,351,897. 5-Pyrazolone couplers having the ballast groups described in European Patent No. 73,636 also produce high color densities.

The pyrazoloazole couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* No. 24220 (June, 1984), and pyrazolopyrazoles as described in *Research Disclosure,* No. 24230 (June, 1984). From the standpoint of obtaining a desirable reduction of yellow side absorption of developed dyes, improvement in light-fastness of developed dyes, and manifestation of the effects of the present invention, imidazo[1,2-b]pyrazoles as disclosed in European Patent No. 119,741 are preferred, and pyrazolo[1,5-b][1,24]triazole as disclosed in European Patent No. 119,869 is more preferred.

Yellow couplers, which can be used in combination, typically include oil-protected type acylacetamido couplers. Specific examples of these couplers are described in U.S. Pat. Nos. 2,407,201, 2,875,057 and 3,265,506. In the present invention, 2-equivalent yellow couplers are preferably used. Typical examples of the 2-equivalent yellow couplers include oxygen atom-release type couplers as described in U.S. Pat. Nos. 3,408,194, 3,447,928, 3,933,501 and 4,022,620; and nitrogen atom-release type couplers as described in Japanese Patent Publication No. 10739/83, U.S. Pat. Nos. 4,401,752 and 4,326,024, *Research Disclosure,* No. 18053 (April, 1979), British Patent No. 1,425,020, and West German Patent Application (OLS) Nos. 2,219,912, 3,126,136, 2,329,587 and 2,433,812. In particular, $\alpha$-pivaloylacetanilide couplers produce dyes excellent in fastness, particularly to light; and -benzoylacetanilide couplers provide high color densities.

Specific but non-limiting examples of the oil-soluble magenta and yellow couplers are shown below.

(M-1)
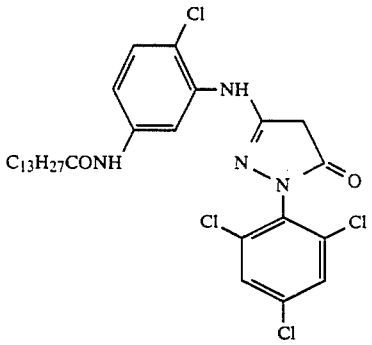
(M-2)
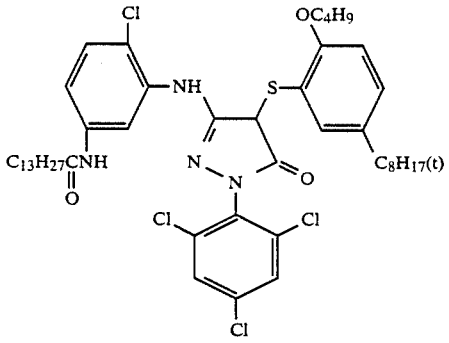
(M-3)
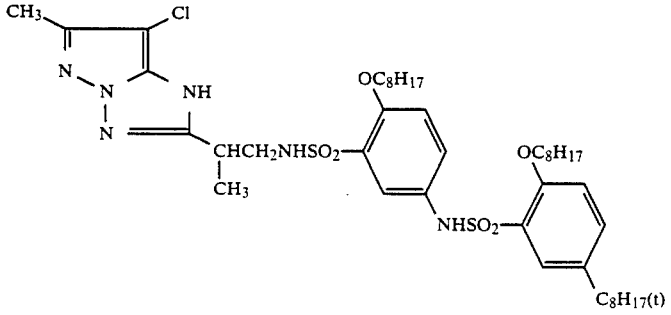
(M-4)
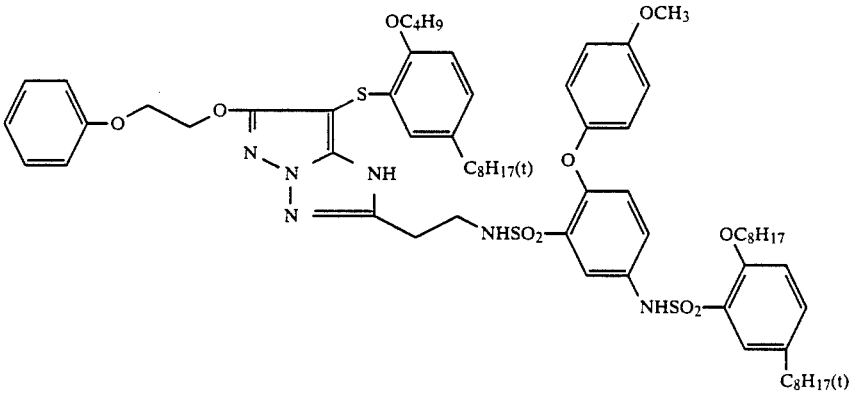

-continued
(M-5)
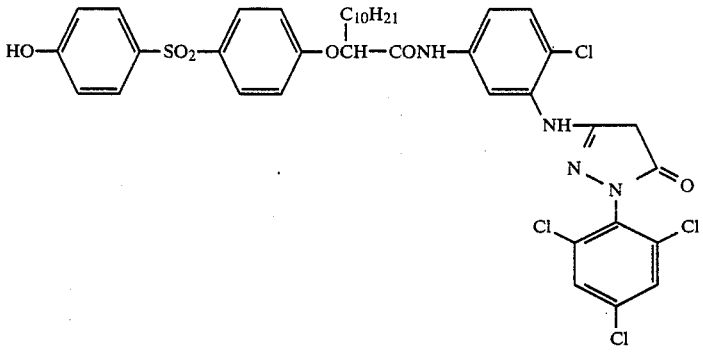
(M-6)
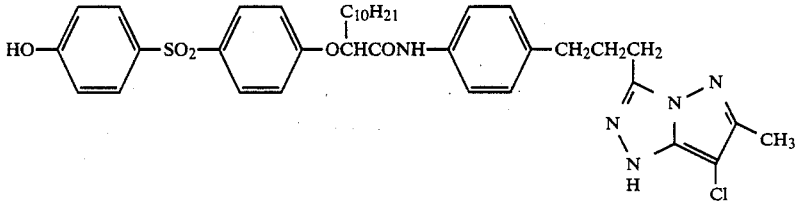
(M-7)
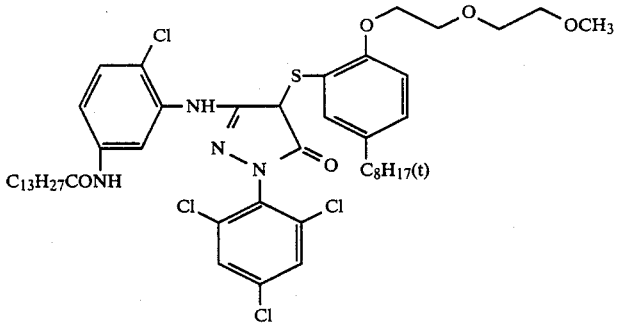
(M-8)
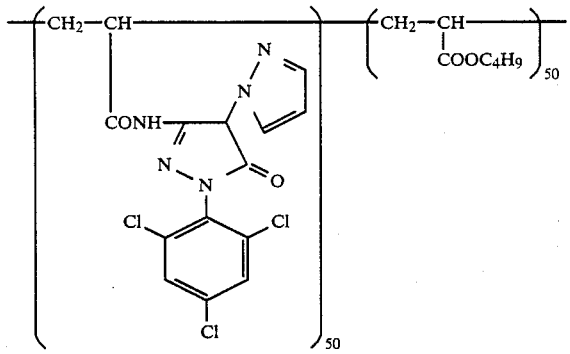
(M-9)
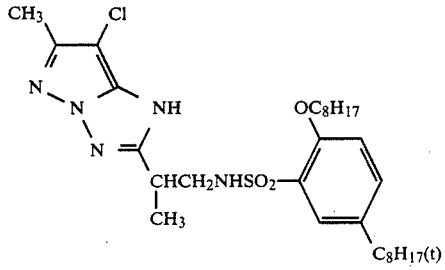

-continued
(M-10)
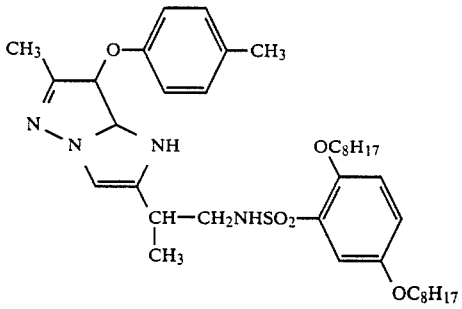
(M-11)
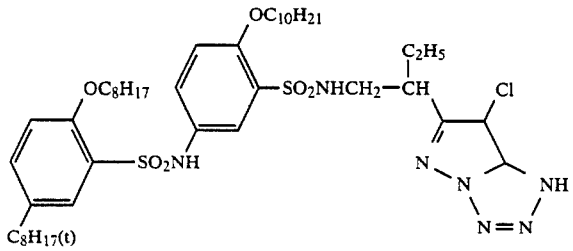
(M-12)
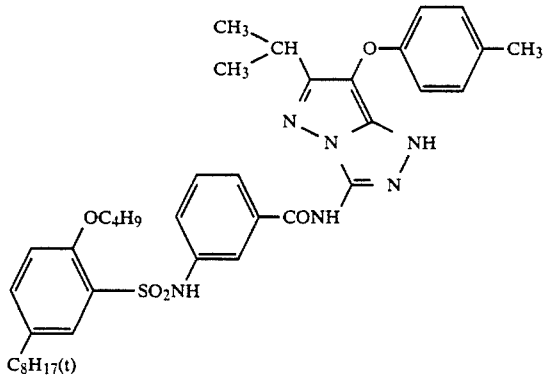
(M-13)
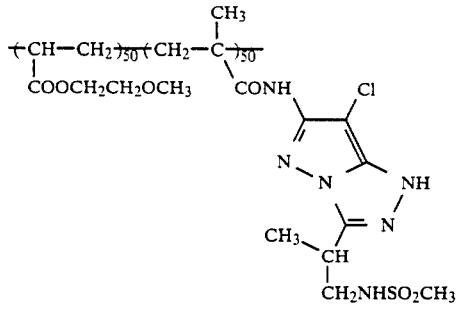
(M-14)
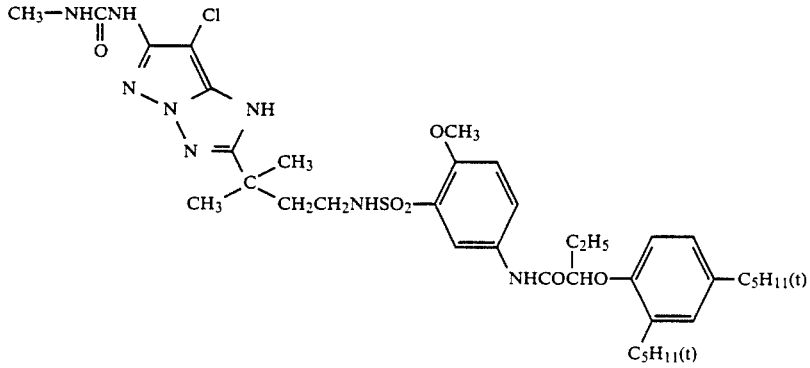

-continued
(Y-1)
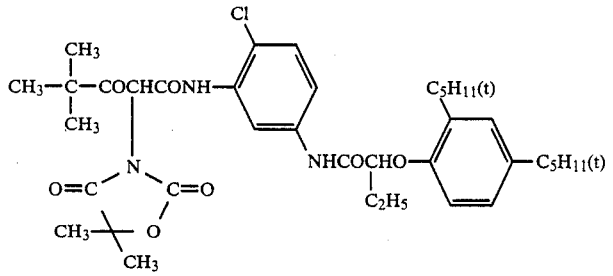
(Y-2)
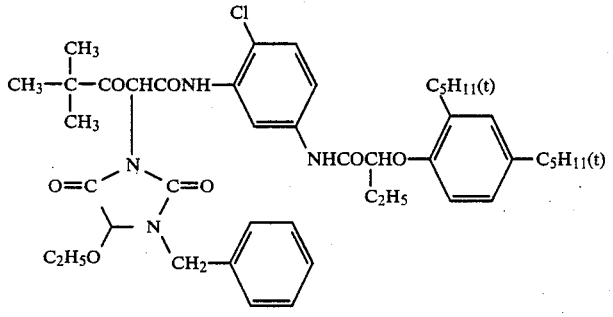
(Y-3)
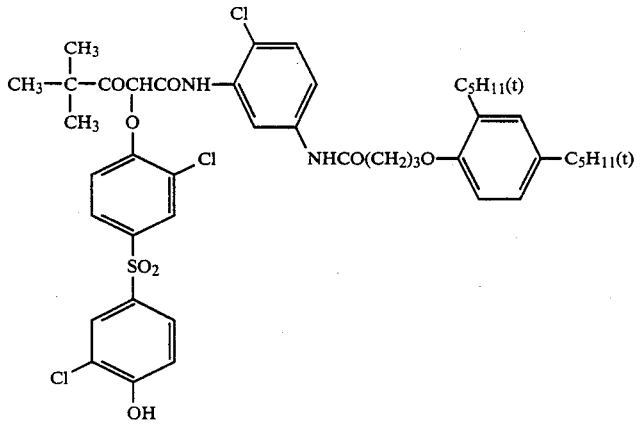
(Y-4)
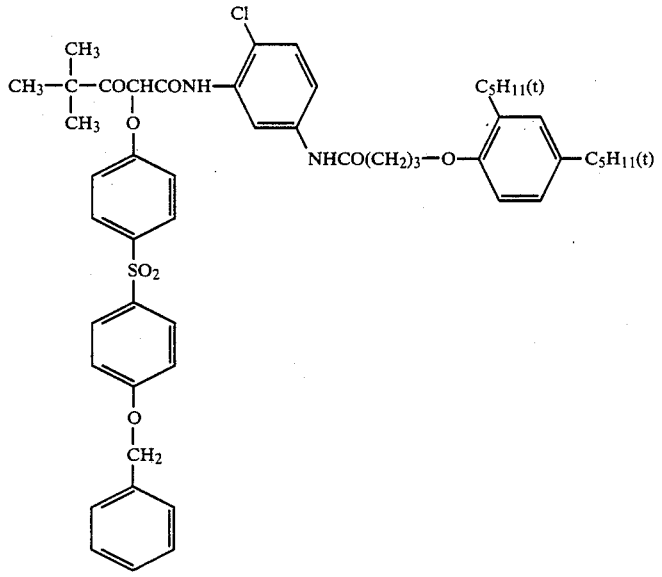

-continued (Y-5)

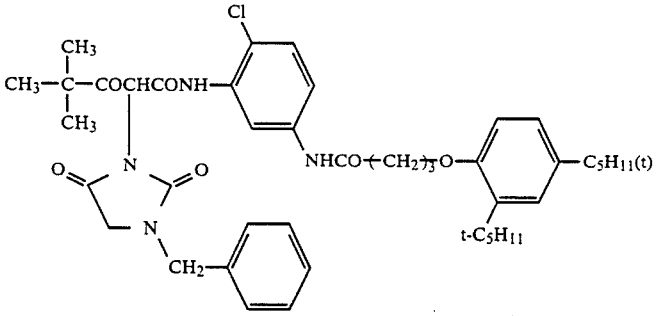

(Y-6)

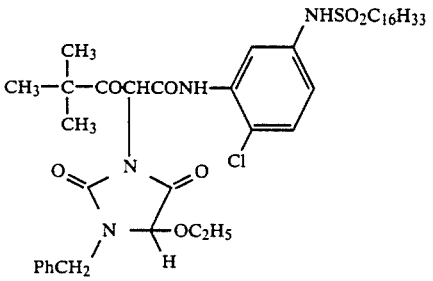

(Y-7)

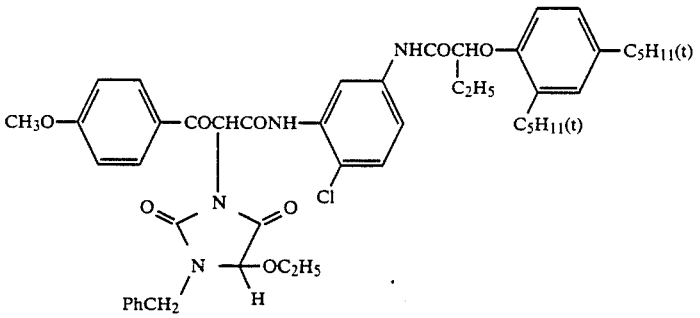

(Y-8)

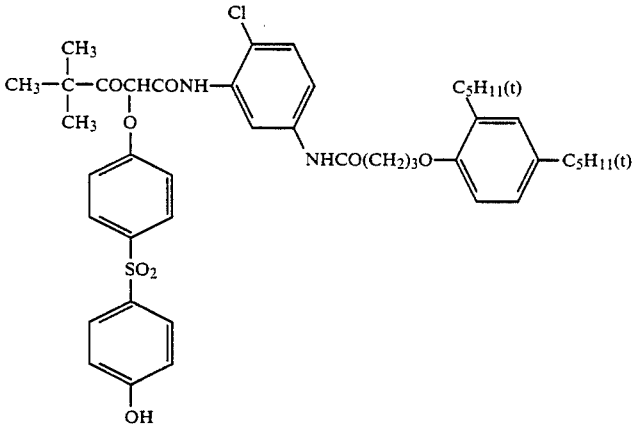

The oleophilic fine particles containing the cyan coupler according to the present invention may further contain various photographically useful hydrophobic additives, such as colored couplers, colorless couplers, developing agents or precursors thereof, development inhibitor precursors, ultraviolet absorbents, development accelerators, gradation controlling agents (e.g., hydroquinones), dyes, dye-releasing compounds, antioxidants, fluorescent brightening agents, discoloration inhibitors, and the like. These hydrophobic additives may be used in combination thereof, is desired.

Photographically useful hydrophobic additives include compounds represented by formulae (IV) to (VI) shown below, which are particularly effective in promoting the desired effects of the present invention, such as improvement of color developability and prevention of discoloration: a compound of formula (IV) is effective as improving color developability and compounds of formulae (V) and (VI) are effective as UV absorbers.

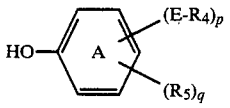

(IV)

wherein E represents a divalent electron attractive group; $R_4$ represents a substituted or unsubstituted alkyl group, a substituted or unsubstituted aryl group, a substituted or unsubstituted alkoxy group, a substituted or unsubstituted aryloxy group, a substituted or unsubstituted alkylamino group, a substituted or unsubstituted anilino group or a substituted or unsubstituted heterocyclic group; p represents 1 or 2; $R_5$ represents a substituted or unsubstituted alkyl group, a substituted or unsubstituted alkoxy group, a hydroxyl group or a halogen atom; q represents 0 or an integer of from 1 to 4; and ring A may be condensed with a benzene ring or a heterocyclic ring;

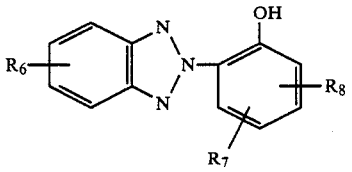

(V)

wherein $R_6$, $R_7$ and $R_8$, which may be the same or different, each represents a hydrogen atom, a halogen atom, a nitro group, a hydroxyl group, a substituted or unsubstituted alkyl group, a substituted or unsubstituted alkoxy group, a substituted or unsubstituted aryl group, a substituted or unsubstituted aryloxy group or a substituted or unsubstituted acylamino group;

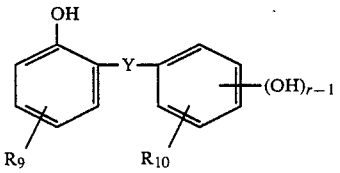

(VI)

wherein $R_9$ and $R_{10}$, which may be the same or different, each represents a hydrogen atom, a substituted or unsubstituted alkyl group, a substituted or unsubstituted alkoxy group or a substituted or unsubstituted acyl group; Y represents —CO— or —COO—; and r represents an integer of from 1 to 4.

Specific but non-limiting examples of the compounds represented by formulae (IV), (V) and (VI) are shown below.

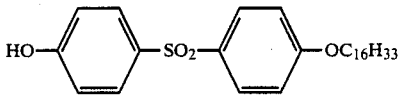

(X-1)

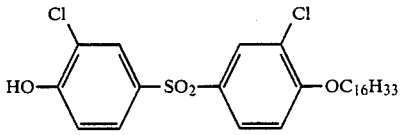

(X-2)

-continued

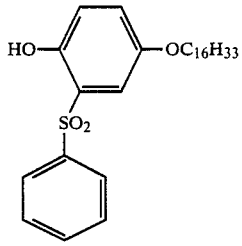

(X-3)

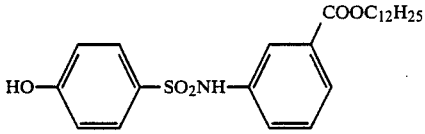

(X-4)

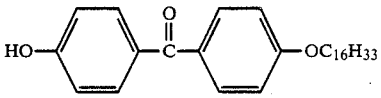

(X-5)

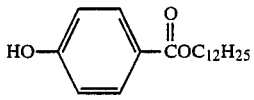

(X-6)

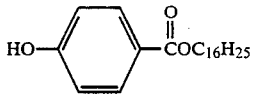

(X-7)

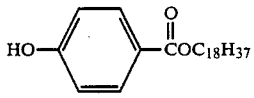

(X-8)

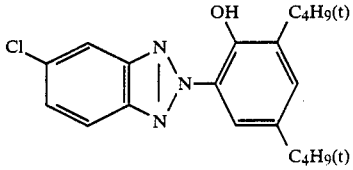

(X-9)

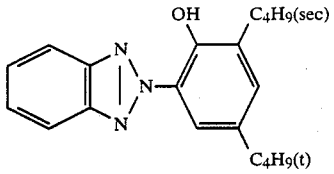

(X-10)

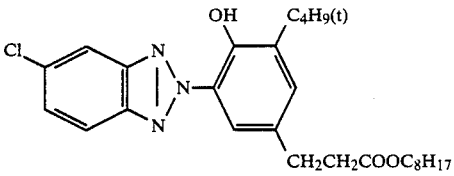

(X-11)

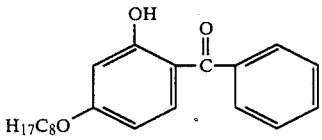

(X-12)

-continued

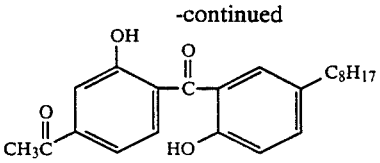

(X-13)

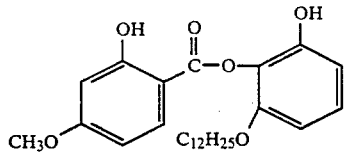

(X-14)

Silver halides which can be used in the silver halide emulsions may be any of those conventionally employed, such as silver chlorobromide, silver chloroiodobromide, etc. The silver halide grains may be coarse grains or fine grins. The grain size may be either narrow or broad, but a mono-dispersed emulsion having a coefficient of size variation of about 15% or less, and particularly 10% or less, is preferred.

The silver halide rains may be regular crystals or irregular crystals (such as spherical, tabular or twin crystals). The ratio of (100) crystals faces to (111) crystal faces is not particularly limited. Further, the crystals may have a homogeneous structure or a layered structure having different halogen compositions. Still further, the silver halides may be of the surface latent, image type or the internal latent image type.

The silver halide grains can be prepared by, e.g., a neutral process, an ammonia process, or an acid process. Also, any of a double jet process, a single jet process, a reverse mixing process, a conversion process, and the like can be employed. Two or more silver halide emulsions separately prepared can be used as a mixture, if desired.

The silver halide photographic emulsions in which silver halide grains are dispersed in a binder solution can be sensitized with chemical sensitizers, such as noble metal sensitizers, sulfur sensitizers, selenium sensitizers, and reducing sensitizers.

Suitable noble metal sensitizers include gold compounds as well as compounds of ruthenium, rhodium, palladium, iridium, platinum, etc. In the case of using gold compounds, ammonium thiocyanate or sodium thiocyanate may be used in combination. Suitable sulfur sensitizers include active gelatin and sulfur compounds. Suitable selenium sensitizers include active or inactive selenium compounds. Suitable reducing sensitizers include stannous salts, polyamines, bisalkylaminosulfides, silane compounds, iminoaminomethanesulfinic acids, hydradinium salts, and hydrazine derivatives.

The light-sensitive materials in accordance with the present invention preferably comprise, in addition to silver halide emulsion layers, auxiliary layers, such as a protective layer, an intermediate layer, a filter layer, an antihalation layer, a backing layer, etc.

Binders of protective colloids to be used in emulsion layers or other layers advantageously include gelatin and, in addition, other hydrophilic colloids, such as proteins, e.g., gelatin derivatives, graft polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. and copolymers comprising monomers constituting the abovementioned homopolymers.

The type of gelatin to be used includes not only lime-processed gelatin, but also acid-processed gelatin or enzyme-processed gelatin as described in *Bull. Soc. Sci. Phot. Japan,* No. 16, 30 (1966). Hydrolysis products and enzymatic decomposition products of gelatin may also be employed.

The emulsion layers and auxiliary layers can appropriately contain various desirable photographic additives, such as antifoggants, dye image discoloration inhibitors, color stain inhibitors, fluorescent brightening agents, antistatic agents, hardening agents, surface active agents, plasticizers, wetting agents, ultraviolet absorbents, and the like, such as those described in *Research Disclosure,* No. 17643 (Dec., 1978).

The silver halide photographic materials of the present invention can be produced by coating the emulsion layers and auxiliary layers containing the desired additives on a support having been previously subjected to corona discharge treatment, flame treatment or ultraviolet irradiation either directly or via a subbing layer and an intermediate layer. Suitable supports which can be advantageously used include baryta paper, polyethylene-coated paper, polypropylene synthetic paper, and transparent supports having a reflective layer coated thereon or having a reflective material such as a titanium white, a zinc oxide, a lead oxide, etc., incorporated in the support, such as a glass plate, a polyester film (e.g., a cellulose acetate film, a cellulose nitrate film, a polyethylene terephthalate film, etc.), a polyamide film, a polycarbonate film, a polystyrene film, and the like. The support to be used is appropriately selected according to the ultimate end use of the photographic material.

The emulsion layers or other constituent layers can be coated by various known coating techniques, such as dip coating, air knife coating, curtain coating, hopper coating, and the like. Two or more layers can be coated simultaneously by the method disclosed in U.S. Pat. Nos. 2,761,791 and 2,941,898, if desired.

In the present invention, the order in which the emulsion layers are coated is not particularly limited. For example, coating on a support may be effected in the order of a blue-sensitive emulsion layer, a green-sensitive emulsion layer, and a red-sensitive emulsion layer, or in the order of a red-sensitive emulsion layer, a green-sensitive emulsion layer, and a blue-sensitive emulsion layer.

An ultraviolet absorbing layer can be provided underneath an emulsion layer farthest from the support and, if necessary, can further be provided on the outer side of the emulsion layer farthest from the support. In the latter case, it is preferred to form a protective layer consisting substantially of gelatin alone as a top layer.

When the present invention is applied to color light-sensitive materials to be used for prints, the material is first exposed to light through a negative film having a color image composed of coupling reaction products, and then is subjected to color development.

Color development processing of the light-sensitive material of the present invention can be carried out according to conventional procedures. A color developing solution to be used for development processing is preferably an alkaline aqueous solution containing an aromatic primary amine color developing agent as a main component, and containing substantially no silver halide solvent. Suitable additives to be used in the color developing solution are described in Japanese Patent Application (OPI) Nos. 144739/85 and 262161/85, and Japanese Patent Application No. 32462/86, pp. 11–22. Preferred development processing conditions are also described in these references, the subject matter of which is expressly incorporated herein by reference. The color developing solution preferably contains an antifoggant, such as heterocyclic thione compounds and aromatic and aliphatic mercapto compounds (e.g., tetraazaindenes, benzimidazoles, benzotriazoles, benzimidazoles, benzothiazoles, benzoxazoles, 1-phenyl-5-mercaptotetrazole, etc.).

After color development, the photographic materials are usually subjected to bleaching. Bleaching be carried out simultaneously with fixation in a bleach-fixing monobath, or alternatively, these two steps may be carried out separately. For the purpose of speeding up processing, bleaching may be followed by bleach-fixing. A bleaching solution or bleach-fixing solution usually contains an aminopolycarboxylic acid iron complex salt as a bleaching agent. Other additives and processing conditions for such bleaching or bleach-fixing steps are described in Japanese Patent Application No. 32462/86, pp. 22–30. The desilvering step (i.e., bleach-fixing or fixation) is then followed by washing and/or stabilization. Additives and processing conditions or methods for washing and stabilization are described in Japanese Patent Application No. 32462/86, pp. 30–36.

According to the present invention, the cyan coupler is dispersed in the presence of the polymer without using a high-boiling point organic solvent, which have been commonly employed for dispersing oleophilic diffusion-resistant couplers, whereby the light-sensitive material can form a cyan image excellent in preservability, particularly resistance to dark discoloration due to conditions of heat and humidity. At the same time, the light-sensitive materials according to the present invention exhibit excellent working preservability, and the problem of diffusing a high-boiling point organic solvent out of the surface of the light-sensitive material can be effectively eliminated.

The present invention will now be illustrated in greater detail by way of Examples, but it should be understood that the present invention is not deemed to be limited thereto. In these examples, all parts, percents, ratios are the like are given by weight unless otherwise indicated.

EXAMPLE 1

A multilayer color light-sensitive material was prepared by coating 1st (lowermost) to 7th (uppermost) layers having compositions shown in Table 1 on a paper support having polyethylene coated on both sides thereof. The polyethylene layer of the support on the side to be coated contained a white pigment (TiO) and a bluing dye (ultramarine). The resulting light-sensitive material was designated as Sample (A).

The method for preparing coating compositions for preparation of Sample (A) is shown below, taking the composition used for the 1st layer as an example.

In 27.2 ml of ethyl acetate and 10.9 g of Solvent (c) were dissolved 19.1 g of Yellow Coupler (a) and 4.4 g of Dye Image Stabilizer (b), and the resulting solution was added to 185 ml of a 10% gelatin aqueous solution containing 16 ml of 10% sodium dodecylbenzenesulfonate, followed by emulsifying in a homogenizer to obtain a dispersion.

Separately, a blue-sensitizing dye having the formula shown below was added to a silver chlorobromide emulsion (silver bromide: 80 mol %; silver content: 70 g/kg) in an amount of $7.0\times10^{-4}$ mol per mol of silver chlorobromide to prepare 90 g of a blue-sensitive emulsion.

The above-prepared dispersion and the emulsion were mixed, and the gelatin concentration was adjusted so as to have the composition shown in Table 1 to prepare a coating composition for the 1st layer.

Each of the coating compositions for the 2nd to 7th layers was prepared in the same manner as described above, but having the compositions shown in Table 1.

In each layer, a sodium salt of 1-hydroxy-3,5-dichloro-s-triazine was used as a gelatin hardener.

The spectral sensitizer used for each of the blue-sensitive emulsion layer, the green-sensitive emulsion layer, and the red-sensitive emulsion layer are shown below.

Spectral Sensitizer for Blue-Sensitive Layer:

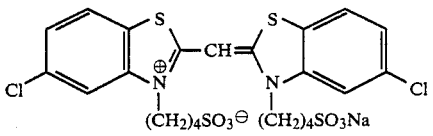

($7.0\times10^{-4}$ mol/mol of silver halide)

Spectral Sensitizer for Green-Sensitive Emulsion Layer:

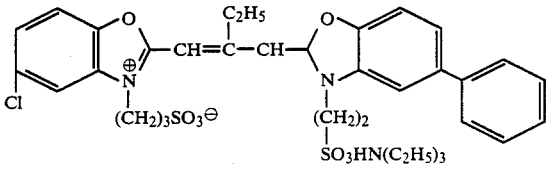

($4.0\times10^{-4}$ mol/mol of silver halide)

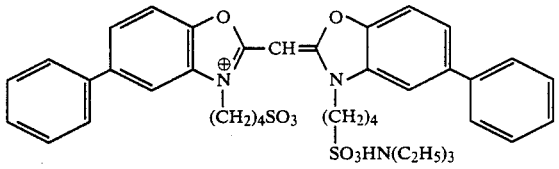

($7.0\times10^{-5}$ mol/mol of silver halide)

Spectral Sensitizer for Red-Sensitive Emulsion Layer:

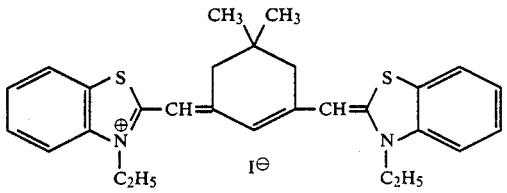

($1.0\times10^{-4}$ mol/mol of silver halide)

The anti-irradiation dye for each of the emulsion layers is as follows.

Anti-Irradiation Dye for Green-Sensitive Emulsion Layer:

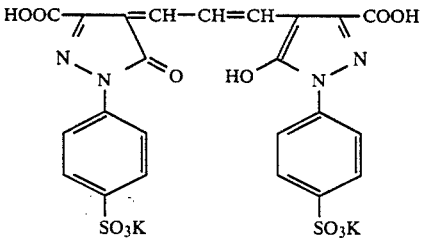

Anti-Irradiation Dye for Red-Sensitive Emulsion Layer:

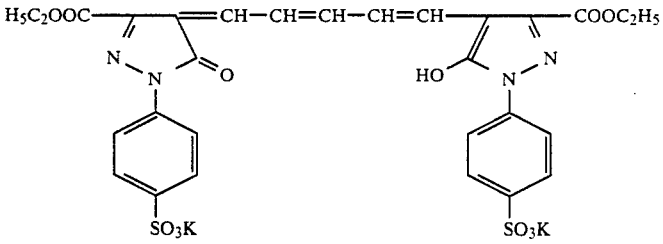

Chemical formulae of the compounds used in the sample separation are shown below.

(a) Yellow Coupler

Compound (Y-2)

(b) Dye Image Stabilizer

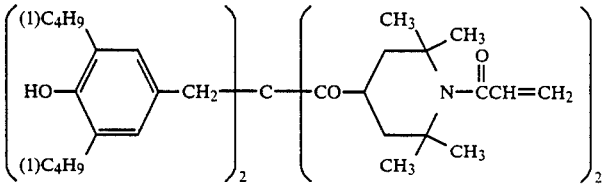

(c) Solvent

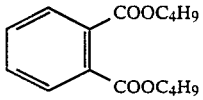

(d) Color Mixing Inhibitor

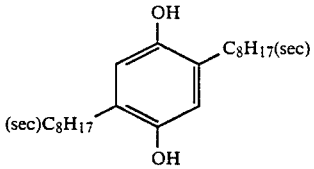

(e) Magenta Coupler

Compound (M-3)

(f) Dye Image Stabilizer

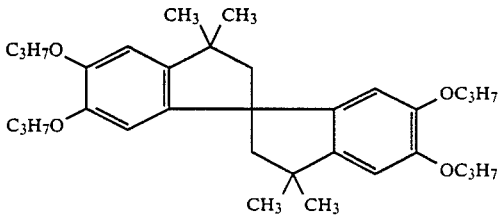

(g) Solvent

A 2:1 (by weight) mixture of

-continued

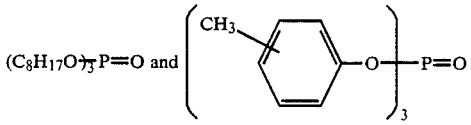

(h) Ultraviolet Absorbent

A 1:5:3 (by mol) mixture of

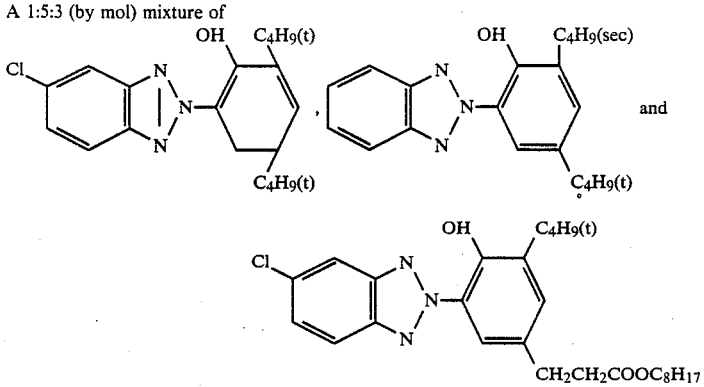

(i) Color Mixing Inhibitor

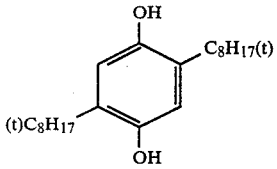

(j) Solvent $(iso\text{-}C_9H_{19}O)_3P{=}O$ (k) Cyan Coupler

Compound (C-1)

(l) Polymer

Polymer (P-57)

(m) Stain inhibitor

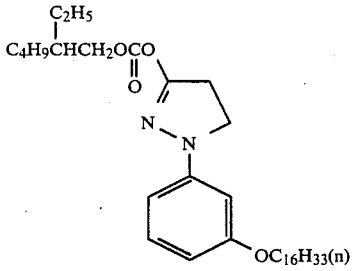

TABLE 1

| Layer | Main Components | Coverge ($g/m^2$) |
|---|---|---|
| Support | Polyethylene-laminated paper (TiO and ultramarine dye on the side to be coated) | |
| 1st Layer (Blue-Sensitive Emulsion Layer) | Silver chlorobromide emulsion (silver bromide: 80 mol %) | 0.30 (Ag) |
| | Gelatin | 1.86 |
| | Yellow Coupler (a) | 0.82 |
| | Dye Image Stabilizer (b) | 0.19 |
| | Solvent (c) | 0.47 |
| 2nd Layer (Color-Mixing Inhibiting Layer) | Gelatin | 0.99 |
| | Color Mixing Inhibitor (d) | 0.08 |
| 3rd Layer (Green-Sensitive Emulsion Layer) | Silver chlorobromide emulsion (silver bromide: 75 mol %) | 0.16 (Ag) |
| | Gelatin | 1.80 |
| | Magenta Coupler (e) | 0.34 |
| | Dye Image Stabilizer (f) | 0.20 |
| | Solvent (g) | 0.60 |
| | Stain Inhibitor (m) | 0.08- |
| 4th Layer (Ultra-violet Absorbing Layer) | Gelatin | 1.60 |
| | Ultraviolet Absorbent (h) | 0.62 |
| | Color Mixing Inhibitor (i) | 0.05 |
| | Solvent (j) | 0.22 |
| 5th Layer (Red-Sensitive Emulsion | Silver chlorobromide emulsion (silver bromide: 70 mol %) | 0.26 (Ag) |
| | Gelatin | 0.98 |
| | Cyan Coupler (k) | 0.41 |

TABLE 1-continued

| Layer | Main Components | Coverge ($g/m^2$) |
|---|---|---|
| Layer) | | (0.8 $mmol/m^2$) |
| | Polymer (l) | 0.20 |
| 6th Layer (Ultra-Violet Absorbing Layer) | Gelatin | 0.54 |
| | Ultraviolet Absorbent (h) | 0.21 |
| | Solvent (j) | 0.20 |
| 7th Layer (Protective Layer) | Gelatin | 1.33 |
| | Acrylic-modified copolymer of polyvinyl alcohol (degree of modification: 17%) | 0.17 |

Samples (B) to (V) and Comparative Samples (1) to (9) were prepared in the same manner as for Sample (A) described above, except that the composition of the cyan coupler fine particles used in the 5th layer (red-sensitive layer) TM as changed as shown in Table 2. In Table 2, cyan couplers, polymers, and high-boiling point organic solvents used in Comparative Samples (1) to (9) are shown below.

Coupler (i)

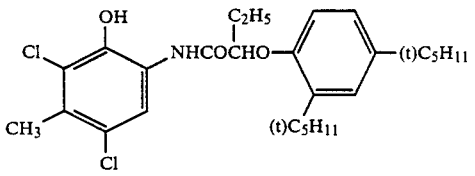

Coupler (ii)

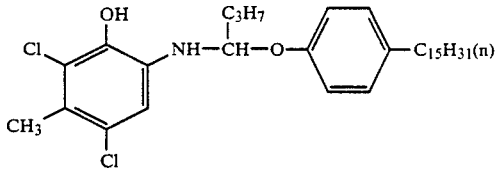

Coupler (iii)

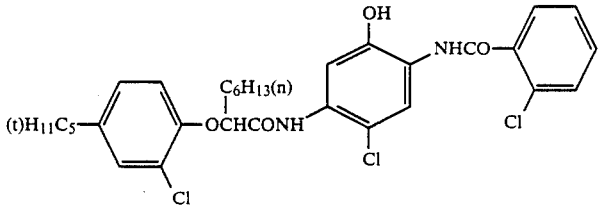

Coupler (iv)

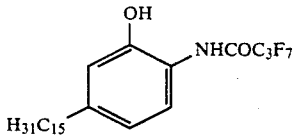

Solvent (S-1)

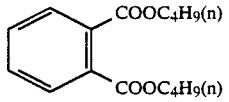

Solvent (S-2)

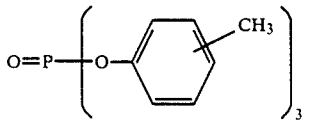

Solvent (S-3)

-continued

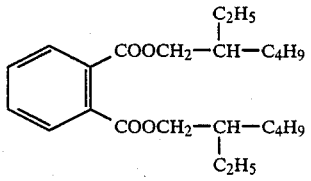

Polymer (m-1)

2-Hydroxyethyl acrylate-butyl acrylate Copolymer (40:60)

Polymer (m-2)

Methyl methacrylate-acrylic acid Copolymer (70:30)

The coupler dispersion used in Sample (V) (Dispersion 1) was prepared as follows. In 50 ml of ethyl acetate was dissolved 10 g of Cyan Coupler (C-4), 2 g of ethyl acrylate, and 5 g of methyl methacrylate, and 0.2 g of azobisisobutyronitrile was added to the solution as a polymerization initiator. The mixture was allowed to react at 60° C. for 10 hours. After completion of the reaction, the reaction mixture was concentrated to a volume of 20 ml. The resulting concentrate was added to 100 ml of an aqueous solution containing 10 g of gelatin and 0.5 g of sodium dodecylbenzenesulfonate at 60° C., and the mixture was vigorously stirred in a homogenizer to prepare a dispersion.

TABLE 2

| Sample No. | Coupler | Polymer Kind | Polymer Amount* | High-Boiling Point Organic Solvent Kind | High-Boiling Point Organic Solvent Amount* | Remarks |
|---|---|---|---|---|---|---|
| (A) | C-1 | P-57 | 0.5 | — | — | Invention |
| (B) | " | " | 1.0 | — | — | " |
| (C) | " | P-3 | 1.0 | — | — | " |
| (D) | " | " | 1.5 | — | — | " |
| (E) | " | P-40 | 1.0 | — | — | " |
| (F) | " | P-21 | 1.0 | — | — | " |
| (G) | C-2 | P-3 | 1.0 | — | — | " |
| (H) | C-2 | P-3 | 1.5 | — | — | " |
| (I) | C-4 | P-57 | 1.0 | — | — | " |
| (J) | " | " | 1.0 | — | — | " |
| (K) | " | P-40 | 1.0 | — | — | " |
| (L) | " | P-21 | 1.0 | — | — | " |
| (M) | C-30 | P-3 | 0.5 | — | — | " |
| (N) | " | " | 1.0 | — | — | " |
| (O) | C-31 | P-57 | 1.0 | — | — | " |
| (P) | " | " | 1.0 | — | — | " |
| (Q) | " | P-40 | 1.0 | — | — | " |
| (R) | " | P-21 | 1.0 | — | — | " |
| (S) | C-2 | P-71 | 1.5 | — | — | " |
| (T) | " | P-72 | 1.0 | — | — | " |
| (U) | " | P-73 | 1.0 | — | — | " |
| (V) | " | Dispersion (1) | | — | — | " |
| (1) | (i) | — | — | S-1 | 0.6 | Comparison |
| (2) | " | — | — | S-2 | 0.6 | " |
| (3) | C-1 | — | — | S-1 | 0.6 | " |
| (4) | " | — | — | S-2 | 0.6 | " |
| (5) | (i) | P-70 | 1.0 | — | — | " |
| (6) | (ii) | m-1 | 0.5 | S-1 | 0.1 | " |
| (7) | (iii) | — | — | S-1 | 0.6 | " |
| (8) | (iv) | — | — | S-1 | 0.6 | " |
| (9) | C-2 | m-2 | 1.0 | — | — | " |

Note: *Weight ratio to coupler

Each of Samples (A) to (V) and (1) to (9) was stepwise exposed to light through each of blue, green and red filters for sensitometry using an FWH type light source manufactured by Fuji Photo Film Co., Ltd; color temperature: 3200° K.) at an exposure at 250 CMS for an exposure time of 0.5 second. The thus exposed sample was subjected to development processing according to the following procedure.

| Step | Temperature (°C.) | Time |
|---|---|---|
| Color Development | 35 | 3'30" |
| Bleach-Fixing | 35 | 1'30" |
| Rinsing | 28–35 | 2'30" |

Each of the processing solutions used had the following formulation:

| | |
|---|---|
| Color Developing Solution Formulation: | |
| Diethylenetriaminetetraacetic acid | 1.0 g |
| Benzyl alcohol | 15 ml |
| Diethylene glycol | 10 ml |
| Sodium sulfite | 2.0 g |
| Potassium bromide | 0.5 g |
| Hydroxylamine sulfate | 3.0 g |
| 4-Amino-3-methyl-N-ethyl-N-[β-methanesulfonamido)ethyl]-p-phenylenediamine sulfate | 5.0 g |
| Sodium carbonate monohydrate | 30 g |
| Fluorescent brightening agent (4,4'-diaminostilbene type) | 1.0 g |
| Water to make | 1 l (pH = 10.1) |
| Bleach-Fixing Bath Formulation: | |
| Ammonium thiosulfate (70 wt %) | 150 ml |
| Sodium sulfite | 15 g |
| Ammonium (ethylenediaminetetraacetato) iron | 55 g |
| Disodium ethylenediaminetetraacetate | 4 g |
| Water to make | 1 l (pH = 6.9) |
| Rinsing Solution Formulation: | |
| Benzotriazole | 0.4 g |
| Water to make | 1 l (pH = 7.0) |

In order to evaluate fastness of the thus formed color images to light, heat and humidity, each of the samples was allowed to stand in a dark place at 100° C. for 5 days, or in a dark place at 80° C. and 70% relative humidity for 12 days, or was exposed to light in a xenon tester (85,000 lux) for 3 days. The degree of cyan discoloration was determined by obtaining a percent reduction of red density at an area having an initial density of 1.5. Further, in order to evaluate working preservability, each of the unexposed samples was preserved at 40° C. and 75% relative humidity for one week, and the difference in logE at D=0.5 between before and after such preservation was determined. These results obtained are shown in Table 3 below.

TABLE 3

| Sample No. | Dark Discoloration 100° C. 5 Days (%) | Dark Discoloration 80° C., 70% RH 12 Days (%) | Light Discoloration 85,000 lux, 3 Days (%) | Sensitivity Change During Preservation (ΔlogE) | Remarks |
|---|---|---|---|---|---|
| (A) | 13 | 10 | 11 | 0.03 | Invention |
| (B) | 9 | 8 | 11 | 0.02 | " |
| (C) | 15 | 13 | 13 | 0.03 | " |
| (D) | 13 | 8 | 14 | 0.03 | " |
| (E) | 20 | 14 | 15 | 0.02 | " |
| (F) | 16 | 11 | 14 | 0.03 | " |
| (G) | 12 | 10 | 14 | 0.02 | " |
| (H) | 9 | 9 | 14 | 0.02 | " |
| (I) | 13 | 12 | 12 | 0.01 | " |
| (J) | 9 | 8 | 13 | 0.01 | " |
| (K) | 21 | 15 | 15 | 0.03 | " |
| (L) | 15 | 10 | 15 | 0.03 | " |
| (M) | 12 | 8 | 13 | 0.02 | " |
| (N) | 7 | 8 | 12 | 0.03 | " |
| (O) | 12 | 10 | 11 | 0.03 | Invention |
| (P) | 8 | 9 | 12 | 0.03 | " |
| (Q) | 22 | 13 | 13 | 0.02 | " |
| (R) | 12 | 8 | 14 | 0.03 | " |
| (S) | 25 | 17 | 15 | 0.04 | " |
| (T) | 23 | 17 | 14 | 0.03 | " |
| (U) | 15 | 13 | 14 | 0.03 | " |
| (V) | 12 | 19 | 13 | 0.03 | " |
| (1) | 50 | 47 | 10 | 0.08 | " |
| (2) | 51 | 45 | 10 | 0.09 | " |
| (3) | 31 | 17 | 13 | 0.07 | " |
| (4) | 32 | 17 | 12 | 0.07 | " |
| (5) | 40 | 37 | 15 | 0.06 | " |
| (6) | 38 | 28 | 8 | 0.04 | " |
| (7) | 4 | 6 | 11 | 0.08 | Comparison |
| (8) | 5 | 6 | 53 | 0.09 | " |
| (9) | 40 | 35 | 13 | 0.04 | " |

From the results of Table 3, the following observations as to the superiority of photographic materials of the present invention can be made.

Samples (A) to (R), in which the cyan coupler/-polymer combinations according to the present invention are used, exhibit markedly superior fastness to heat and humidity as compared with Comparative Samples (1) to (9). Moreover, these samples (A) to (R) undergo little change in sensitivity, and are quite free from the occurrence of undesirable phenomena, such as oozing of oils (solvents) on their surfaces, when preserved under conditions of high temperature and high humidity.

In cases where Comparative Coupler (i) is used in combination with the conventionally employed high-boiling point organic solvents (as in Samples (1) and (2)), image fastness to heat and humidity is seriously deteriorated.

In cases where the couplers of the present invention are combined with the conventionally employed high-boiling point organic solvents (as in Samples (3) and (4)), some improvement as to discoloration due to heat and humidity can be obtained as compared with cases of using couplers having a methyl group at the m-position of the phenol nucleus, for example, Comparative Coupler (i). Nevertheless, the degree of image fastness is still unsatisfactory in these Samples. In addition, use of the high-boiling point organic solvents tends to cause conspicuous reduction in sensitivity or oozing of oils on the surfaces when these light-sensitive materials are preserved under conditions of high temperature and high humidity.

As can be seen from the results of Sample (5), a combination of Comparative Coupler (i) (as described in Example 2 of Japanese Patent Publication No. 30494/73) and the polymer of the present invention attains slightly improved affects as to discoloration due to heat, humidity and light when compared with cases of combining them with conventional high-boiling point organic solvents. Nevertheless, the resulting effects are still unsatisfactory, and occur to a much lesser degree than attained by the photographic materials of the present invention.

In cases where Comparative Coupler (ii) (as described in Example 2 of Japanese Patent Application (OPI) No. 25133/76) is combined with polymer (m-1) and dispersing oil (S-1) as in Sample (6), some improvement in heat discoloration and light discoloration can be obtained, but the degree of improvement is still insufficient. Besides, such a light-sensitive material turned out to be inferior as to working preservability in comparison with the photographic material of the present invention. That is, these comparative samples underwent a great change in sensitivity when preserved at 40° C. and 75% relative humidity for one week, or were found to suffer from slight oozing out of the oil when preserved at 60° C. and 80% relative humidity for 3 days.

As is shown by Samples (7) and (8), the light-sensitive materials using the 2,5-diacylamino coupler disclosed in Japanese Patent Application (OPI) No. 163537/80 or the coupler disclosed in U.S. Pat. No. 2,895,826 in combination with conventional high-boiling point organic solvents exhibit fairly good results as to resistance to discoloration due to heat and humidity. However, they are considerably poorer in resistance to light discoloration, and are unsatisfactory in terms of sensitivity change or oozing out of oils when preserved before use.

It is apparent from the results shown for Samples (A) to (R), in which the cyan couplers of the present invention are combined with the polymers of the present invention in place of the conventional high-boiling point organic solvents, that the present invention produces remarkably pronounced effects as to improvements in image fastness to heat and humidity.

When the conventional dispersion technique using high-boiling point organic solvents is applied to the cyan coupler according to the present invention, image fastness to heat discoloration and humidity discoloration can be improved over the cases where the same technique is applied to the conventional cyan couplers having a methyl group at the meta-position of the phenol nucleus, e.g., Comparative Coupler (i), as discussed above. In this regard, it is surprising that replacement of the high-boiling point organic solvents with the polymers according to the present invention brings about such marked improvement, as shown for in Samples (A) to (B).

Sensitivity changes observed when light-sensitive materials are preserved under conditions of high temperature and high humidity are smaller when the polymers of the present invention are combined with the couplers of the present invention than with Comparative Coupler (i). Further, the samples according to the present invention do not suffer from oozing of oils on their surfaces, even when preserved under conditions of high temperature and high humidity.

It can also be seen by comparing Samples (S) to (U) with Comparative Sample (9) that polymers having a minor proportion of an acid radical also produce significant, desirable effects.

EXAMPLE 2

Onto a polyethylene-laminated (both sides) paper having been previously subjected to corona discharge treatment were coated 1st (lowermost) to 7th (uppermost) layers as shown in Table 4. The resulting light-sensitive material was designated as Sample (W).

Yellow Coupler (n)

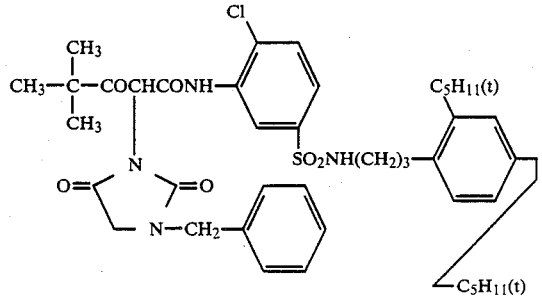

The coating composition for the 1st layer was prepared as follows. A mixture consisting of 200 g of Yellow Coupler (n), 93.3 g of Discoloration Inhibitor (o), 10 g of High-Boiling Point Organic Solvent (p), 5 g of High-Boiling Point Organic Solvent (q), and 60 ml of ethyl acetate as an auxiliary solvent was heated to 60° C. to form a solution. The solution was mixed with 3,300 ml of a 5 wt % aqueous solution of gelatin containing 330 ml of a 5 wt % aqueous solution of Alkanol B (alkylnaphthalene sulfonate, manufactured by E. I. Du Pont Co.), followed by emulsification by the ue of the colloid mill to prepare a coupler dispersion. After removing the ethyl acetate from the dispersion by distillation under reduced pressure, the coupler dispersion was mixed with 1,400 g of a silver chlorobromide emulsion (Ag content: 96.7 g; gelatin content: 170 g) to which a blue-sensitizing dye as shown below and 1-methyl-2-mercapto-5-acetylamino-1,3,4-triazole had been added. To the dispersion was further added 2,600 g of a 10% aqueous solution of gelatin to prepare a coating composition for the 1st layer. The coating compositions for the 2nd to 7th layers were prepared in the similar manner, and these compositions are described in detail in Table 4.

Sensitizing dyes used for emulsion layers are as follows:

Sensitizing Dye for Blue-Sensitive Layer:
Anhydro-5-methoxy-5'-methyl-3,3'-disulfopropylselenacyanine hydroxide
Sensitizing Dye for Green-Sensitive Layer:
Anhydro-9-ethyl-5,5'-diphenyl-3,3'-disulfoethyloxacarbocyanine hydroxide
Sensitizing Dye for Red-Sensitive Layer:
3,3'-Diethyl-5-methoxy-9,9'-(2,2-dimethyl-1,3-propano)thiadicarbocyanine iodide
A stabilizer and anti-irradiation dyes used in the emulsion layers and a gelatin hardener used in each layer are shown below:
Stabilizer:
1-methyl-2-mercapto-5-acetylamino-1,3,4-triazole
Anti-Irradiation Dyes:
Dipotassium 4-(3-carboxy-5-hydroxy-4-(3-carboxy-5-oxo-1-(4-sulfonatophenyl)-2-pyrazolin-4-ylidene)-1-propenyl)-1-pyrazolyl)benzenesulfonate
Tetrasodium N,N'-(4,8-dihydroxy-9,10-dioxo-3,7-disulfonatoanthrazene-1,5-diyl)bis(aminomethanesulfonate)
Hardener
1,2-Bis(vinylsulfonyl)ethane Other compounds shown in Table 4 used for the sample preparation are as follows:

Discoloration Inhibitor (o)
2,5-Di-t-amylphenyl-3,5-di-t-butylhydroxybenzoate
Solvent (p)
Di(2-hexylhexyl)phthalate
Solvent (q)
Dibutyl phthalate
Color mixing Inhibitor (r)
2,5-Di-t-octylhydroquinone Magenta Coupler (s)

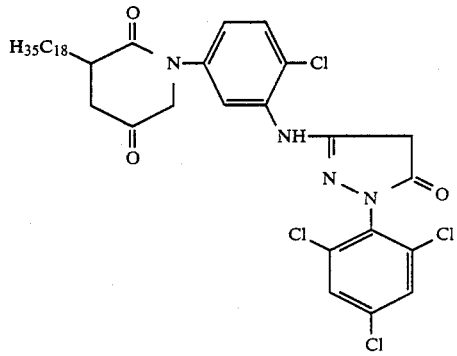

Discoloration Inhibitor (t)
1,4-Di-t-amyl-2,5-dioctyloxybenzene
Discoloration Inhibitor (u)
2,2'-Methylenebis(4-methyl-6-t-butylphenol)
Ultraviolet Absorbent (v)
2-(2-Hydroxy-3,5-di-t-amylphenyl)benzotriazole
Ultraviolet Absorbent (w)
2-(2-Hydroxy-3,5-di-t-butylphenyl)benzotriazole

TABLE 4

| Layer | Main Components | Coverge (mg/m$^2$) |
|---|---|---|
| Support | Polyethylene-laminated paper | |
| 1st Layer (Blue-Sensitive Emulsion Layer) | Silver chlorobromide emulsion (silver bromide: 5 mol %) | 290 |
| | Yellow Coupler (n) | 600 |
| | Discoloration Inhibitor (o) | 280 |
| | Solvent (p) | 30 |
| | Solvent (q) | 15 |
| | Gelatin | 1800 |
| 2nd Layer | Silver bromide emulsion | 10 |

TABLE 4-continued

| Layer | Main Components | Coverge (mg/m²) |
|---|---|---|
| (Color-Mixing Inhibiting Layer) | (primitive, grain size: 0.05 μm) | (Ag) |
| | Color Mixing Inhibitor (r) | 55 |
| | Solvent (p) | 30 |
| | Solvent (q) | 15 |
| | Gelatin | 800 |
| 3rd Layer (Green-Sensitive Emulsion Layer) | Silver chlorobromide emulsion (silver bromide: 3 mol %) | 305 |
| | Magenta Coupler (s) | 670 |
| | Discoloration Inhibitor (t) | 150 |
| | Discoloration Inhibitor (u) | 10 |
| | Solvent (p) | 200 |
| | Solvent (q) | 10 |
| | Gelatin | 1400 |
| 4th Layer (Color Mixing Inhibiting Layer) | Color Mixing Inhibitor (r) | 65 |
| | Ultraviolet Absorbent (v) | 450 |
| | Ultraviolet Absorbent (w) | 230 |
| | Solvent (p) | 50 |
| | Solvent (q) | 50 |
| | Gelatin | 1700 |
| 5th Layer (Red-Sensitive Emulsion Layer) | Silver chlorobromide emulsion (silver bromide: 1 mol %) | 210 |
| | Cyan Coupler (C-3) | 380 |
| | Discoloration Inhibitor (o) | 250 |
| | Polymer (P-3) | 380 |
| | Gelatin | 1800 |
| 6th Layer (Ultra-Violet Absorbing Layer) | Ultraviolet Absorbent (v) | 260 |
| | Ultraviolet Absorbent (w) | 70 |
| | Solvent (p) | 300 |
| | Solvent (q) | 100 |
| | Gelatin | 700 |
| 7th Layer (Protective Layer) | Gelatin | 600 |

Samples (X) to (Z) and Comparative Samples (1) to (11) were prepared in the same manner as for Sample (W), except that the composition of the cyan coupler fine particles used in the 5th Layer (red-sensitive layer) was changed as shown in Table 5.

TABLE 5

| Sample No. | Coupler | Polymer Kind | Polymer Amount* | High-Boiling Point Organic Solvent Kind | High-Boiling Point Organic Solvent Amount* | Remarks |
|---|---|---|---|---|---|---|
| (W) | C-1 | P-57 | 0.5 | — | — | Invention |
| (X) | C-3 | " | " | — | — | " |
| (Y) | C-31 | " | " | — | — | " |
| (Z) | C-3 | P-3 | 0.5 | — | — | " |
| (10) | (i) | — | — | S-1 & S-3 | 0.6 | Comparison |
| (11) | C-2 | — | — | S-1 & S-3 | 0.6 | " |

Note: *Weight ratio to coupler

Each of Samples (W) to (2) and (10) to (11) was sensitometrically exposed to light in the same manner as in Example 1, and the thus exposed samples were then subjected to development processing according to the following procedure:

| Step | Temperature (°C.) | Time |
|---|---|---|
| Color Development | 35 | 1'30" |
| Bleach-Fixing | 35 | 45" |
| Rinsing | 28–35 | 2'30" |

Each of the processing solutions used has the following formulation.

| | |
|---|---|
| Color Developing Solution Formulation: | |
| Water | 800 ml |
| Diethylenetriaminetetraacetic acid | 1.0 g |
| N,N-Diethylhydroxylamine | 4.2 g |
| Potassium bromide | 0.01 g |
| Sodium chloride | 1.5 g |
| Triethanolamine | 8.0 g |
| Potassium carbonate | 30 g |
| N-Ethyl-N- (β-methanesulfonamidoethyl)-3-methyl-4-aminoaniline sulfate | 4.5 g |
| 4,4'-Diaminostilbene type fluorescent brightening agent ("WHITEX 4", produced by Sumitomo Chemical Co., Ltd.) | 2.0 g |
| Water to make | 1 l |
| Potassium hydroxide to adjust pH to | 10.25 |
| Bleach-Fixing Bath Formulation: | |
| Ammonium thiosulfate (54 wt %) | 150 ml |
| Sodium sulfite | 15 g |
| Ammonium (ethylenediaminetetra-acetato) iron (III) | 55 g |
| Disodium ethylenediaminetetraacetate | 4 g |
| Glacial acetic acid | 8.61 g |
| Water to make | 1 l (pH = 5.4) |
| Rinsing Solution Formulation: | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth chloride (40 wt %) | 0.5 g |
| Nitrilo-N,N,N-trimethylenephosphonic acid (40 wt %) | 2.5 g |
| 1-Hydroxyethylidene-1,1-diphosphonic acid (60 wt %) | 2.5 g |
| 4,4'-Diaminostilbene type fluoresent brightening agent | 1.0 g |
| Aqueous ammonia (26 wt %) | 2.0 ml |

The thus processed sample was evaluated for fastness to heat and humidity in the same manner as in Example 1. The results obtained are shown in Table 6:

TABLE 6

| Sample No. | Dark Discoloration 100° C., 5 Days (%) | Dark Discoloration 80° C., 75% RH 12 Days (%) | Remarks |
|---|---|---|---|
| (W) | 13 | 13 | Invention |
| (X) | 12 | 10 | " |
| (Y) | 12 | 10 | " |
| (Z) | 13 | 11 | " |
| (10) | 48 | 46 | Comparison |
| (11) | 30 | 17 | " |

It can be seen from Table 6 that the coupler/polymer combinations according to the present invention result in color images which are excellent in resistance to dark discoloration.

Although the present invention has been described in detail and with reference to specific embodiments thereof, it will be apparent to one skilled in the art that various changes and modifications can be made therein without departing from the spirit and scope thereof.

While the invention has been described in detail and with reference to specific embodiment thereof, it will be apparent to one skilled in the art that various changes and modifications can be made therein without departing from the spirit and thereof.

What is claimed is:

1. A silver halide color photographic material comprising a support having thereon at least one silver halide emulsion layer containing a dispersion, said dispersion comprising oleophilic fine particles containing (a)

at least one oil-soluble cyan coupler represented by formula (I)

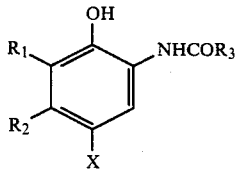

(I)

wherein $R_1$ represents a hydrogen atom or a halogen atom; $R_2$ represents a straight chain or branched chain alkyl group having from 2 to 4 carbon atoms; $R_3$ represents a ballast group; and X represents a hydrogen atom or a coupling releasable group, said coupler being capable of forming a substantially non-diffusible cyan dye upon coupling with an oxidation product of an aromatic primary amide developing agent, and (b) a water-insoluble, organic solvent-soluble vinyl homopolymer or copolymer comprising a repeating unit having a

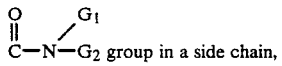

group in a side chain, wherein $G_1$ represents a hydrogen atom and $G_2$ represents an unsubstituted alkyl group or a substituted or unsubstituted phenyl group, wherein said repeating unit when present in a copolymer is present in an amount of at least 60 mol %, and further comprising not more than about 20% by weight of a repeating unit having an acid radical in the main chain or a side chain thereof, wherein said homopolymer or copolymer has a number average molecular weight of not more than 150,000 and said dispersion does not contain in high-boiling point organic solvents having a boiling point of about 140° C. or higher.

2. A silver halide color photographic material as in claim 1, wherein said cyan coupler is represented by formula (II)

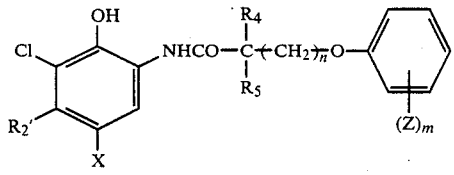

(II)

wherein X is as defined in claim 1; $R_2'$ represents an alkyl group having from 2 to 4 carbon atoms; $R_4$ and $R_5$, which may be the same or different, each represents a hydrogen atom or au alkyl group; n represents 0 or an integer of from 1 to 3; Z represents an alkyl group having from 1 to 16 carbon atoms; m represents an integer of from 1 to 2; and the total number of carbon atoms in $(Z)_m$, $R_4$, and $R_5$ is at least 8; or said cyan coupler is represented by formula (III)

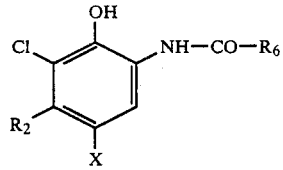

(III)

wherein $R_2$ and X are as defined in claim 1; and $R_6$ represents an unsubstituted straight chain or branched chain aliphatic hydrocarbon group, or a straight chain or branched chain aliphatic hydrocarbon group substituted with at least one of a chlorine atom, an alkoxy group, an alkylthio group, an arylthio group, an alkylsulfonyl group, an arylsulfonyl group, a sulfonamido group, an acylamino group, an alkyloxycarbonyl group, an aryloxycarbonyl group, a carbamoyl group, an alkylcarbonyloxy group, an alkyloxycarbonyl group, a carboxyl group, and a hydroxyl group; or $R_6$ represents a divalent group capable of linking to form a dimer or higher polymer.

3. A silver halide color photographic material as in claim 1, wherein said dispersion is obtained by dissolving said coupler and said homopolymer or copolymer in a low-boiling point organic solvent and dispersing the resulting solution in a hydrophilic binder.

4. A silver halide color photographic material as in claim 1, wherein said dispersion is obtained by polymerizing a monomer or monomers constituting said homopolymer or copolymer by suspension polymerization, solution polymerization or bulk polymerization, and dispersing the resulting polymerization mixture in the presence of said coupler in a hydrophilic binder.

5. A silver halide color photographic material as in claim 1, wherein said homopolymer or copolymer comprises not more 5% by weight of a repeating unit having an acid radical in the main chain or a side chain thereof.

6. A silver halide color photographic material as in claim 1, wherein said homopolymer or copolymer has no repeating unit having an acid radical in the main chain or a side chain thereof.

* * * * *